US008516762B1

(12) United States Patent
Jendusa

(10) Patent No.: US 8,516,762 B1
(45) Date of Patent: Aug. 27, 2013

(54) COMPOSITE FLOOR SYSTEMS AND APPARATUS FOR SUPPORTING A CONCRETE FLOOR

(75) Inventor: James F. Jendusa, Oconomowoc, WI (US)

(73) Assignee: Lightweight Structures LLC, Hartland, WI (US)

( * ) Notice: Subject to any disclaimer, the term of this patent is extended or adjusted under 35 U.S.C. 154(b) by 479 days.

(21) Appl. No.: 12/766,767

(22) Filed: Apr. 23, 2010

Related U.S. Application Data

(63) Continuation-in-part of application No. 12/031,877, filed on Feb. 15, 2008, now abandoned.

(51) Int. Cl.
*E04B 1/18* (2006.01)

(52) U.S. Cl.
USPC ..... 52/414; 52/407.4; 52/650.3; 52/220.2; 52/842

(58) Field of Classification Search
USPC ..... 52/220.2, 407.4, 334, 258, 251, 262, 52/263, 264, 649.1, 414, 650.3, 656.9, 842
See application file for complete search history.

(56) References Cited

U.S. PATENT DOCUMENTS

| | | | | | |
|---|---|---|---|---|---|
| 1,360,720 | A * | 11/1920 | Brown et al. | 52/838 |
| 2,164,138 | A * | 6/1939 | London | 52/407.4 |
| 2,415,200 | A * | 2/1947 | Willett et al. | 160/328 |
| 2,914,816 | A * | 12/1959 | Lundgren | 52/645 |
| 3,332,197 | A * | 7/1967 | Hinkle | 52/844 |
| 3,381,439 | A * | 5/1968 | Thulin, Jr. | 52/842 |
| 3,557,511 | A * | 1/1971 | Curran | 52/414 |
| 3,890,750 | A * | 6/1975 | Berman et al. | 52/127.3 |
| 3,956,864 | A * | 5/1976 | Fung | 52/414 |
| 4,128,975 | A | 12/1978 | Abate | |
| 4,592,184 | A * | 6/1986 | Person et al. | 52/334 |
| 4,729,201 | A * | 3/1988 | Laurus et al. | 52/334 |
| 5,515,659 | A | 5/1996 | MacDonald et al. | |
| 6,085,479 | A | 7/2000 | Carver | |
| 6,148,586 | A | 11/2000 | Jandl | |
| 6,158,190 | A | 12/2000 | Seng | |
| 6,363,674 | B1 | 4/2002 | Carver | |
| 6,457,288 | B2 | 10/2002 | Zambelli et al. | |
| 6,494,012 | B2 | 12/2002 | Seng | |
| 6,691,478 | B2 | 2/2004 | Daudet et al. | |
| 2003/0101669 | A1 | 6/2003 | Toulemonde et al. | |
| 2003/0172607 | A1 | 9/2003 | Brandes | |
| 2008/0022624 | A1 * | 1/2008 | Hanson et al. | 52/702 |

* cited by examiner

*Primary Examiner* — Branon Painter
(74) *Attorney, Agent, or Firm* — Brinks Hofer Gilson & Lione

(57) ABSTRACT

An apparatus for supporting a concrete floor includes at least two joist assemblies. Each joist assembly includes a male frame member and a female frame member. A plurality of top joist clips retain a top of the male frame member against the female frame member and a plurality of bottom joist clips retain a bottom of the male frame against the female frame member. A plurality of bottom and top straps are used to retain a distance between two adjacent joist assemblies. A cross brace is used to retain a distance between two adjacent joist assemblies. A deck panel is retained and supported between two adjacent joist assemblies. Concrete is poured over a top of the deck panel to form a composite floor system. An exterior insulating finishing system is attached to the concrete, while it is still wet to form a composite wall system.

23 Claims, 20 Drawing Sheets

COMPOSITE FLOOR SYSTEMS AND APPARATUS FOR SUPPORTING A CONCRETE FLOOR

CROSS-REFERENCES TO RELATED APPLICATIONS

This is a continuation-in-part application taking priority from Ser. No. 12/031,877 filed on Feb. 15, 2008 now abandoned.

BACKGROUND OF THE INVENTION

1. Field of the Invention

The present invention relates generally to building components and more particularly to an apparatus for supporting a concrete floor and composite floor systems constructed therewith.

2. Discussion of the Prior Art

Many commercial buildings and some larger, multi-story residential complexes, such as apartment buildings or condominiums, utilize concrete floor decking or concrete floors in their construction. Concrete floor decking has also become increasingly popular in residential and smaller constructions over the last decade. Concrete floor support systems have several advantages over traditional decking materials, such as strength, rigidity, durability, mold resistance, sound attenuation, suitability for in-floor radiant heating and the availability of decorative concrete finishes.

Traditional concrete flooring systems were adapted from commercial construction, and generally constructed by spanning steel or wood joists between structural walls or primary structural members, spacing or bridging the joists with rebar or blocking members to provide lateral support to the joists, and laying plywood, steel, aluminum, or fiberglass decking on or between the joists and pouring a thick concrete layer over the decking. The resulting flooring systems are heavy and require significant time to install. Further, in order to bear the additional weight of the decking and concrete layer during curing, the decking panels must be shored (or braced), adding to the cost of the systems. In smaller constructions, such as residential applications, these traditional systems were generally too expensive and logistically challenging to install.

Further, in application, conventional concrete flooring systems are subject to significant horizontal and vertical forces, and in particular, horizontal shear occurring along the longitudinal top of primary and secondary joist members. Indeed, these systems ultimately fail because of loss of interfacial force in the shear span.

Composite concrete floor support systems offer a solution to traditional concrete floor systems. Composite systems utilize steel joists having a top chord or portion that is embedded into the poured concrete deck. The top chord then forms a shear connector to prevent slippage from occurring between the concrete slab and the joist, due to horizontal shear along the joist, which can reduce the amount of reinforcement required over the traditional systems.

Various forms of shear connectors have been developed, including elongated studs welded to the top chord of the joist member. The studs are embedded in the concrete, thereby transferring horizontal shear forces from the slab to the beam. However, these studs are welded to the joist after the joist has been connected to the structure during erection, requiring significant labor and time, and they can be hazardous to crew members after installation, but before the concrete has been poured. Other types of shear connectors include, joists having an irregular or S-shaped tap chord, such as the Hambro™ joist, or alternatively, a shear connector of the type disclosed in U.S. Pat. No. 7,013,613 to Boellner et al., which teaches an extended length shear connector including protrusions and indentations on the surface thereof.

Regardless of the shear connector used in the prior art systems described above, these systems still require reinforcement of the concrete layer. In particular, rebar (reinforcing bar), metal mesh, decking or cross braces are placed over or in between the joists to reinforce the concrete layer before the concrete is poured. Accordingly, this type of composite system, while having increased strength over non-composite systems, can be heavy and expensive due to the added cost of reinforcement material. However, rebar and other metal reinforcements are subject to corrosion and deterioration of the floor. Further, in systems where the reinforcement is positioned on top of the top chord or shear connector, these systems are subject to failure due to tearing of the deck near the shear connector.

In addition, many of the prior art systems require removable framing systems to be in place before construction and removed after the concrete has cured, adding to the cost of installation of these types of composite systems.

Accordingly, there is a need for a lighter floor support system for use with concrete floor decking, in particular, for use in above-grade and residential constructions, while also offering decreased costs and ease of installation on-site.

SUMMARY OF THE INVENTION

A composite flooring system and method for supporting a concrete flooring system in accordance with one embodiment of the present invention can be used in situations where conventional wood, masonry, or light gauge steel framing materials are used. The system includes a plurality of joist assemblies having a shear connector secured thereto, the joist assemblies arranged in a spaced apart and substantially parallel configuration, with a panel supported between each pair of adjacent joist assemblies, and a concrete layer provided over the panel and shear connector components.

The joist assembly includes a first frame member having a top flange, a web portion and a bottom flange and a second frame member of mirror image construction. The frame members are arranged in a back-to-back fashion, providing the joist assembly with a two layered and reinforced web portion. The web portions of each of the frame members include a plurality of space-apart clips and tabs, which can secure a support angle in place on the web portion of the frame member along the length thereof for supporting sections of polystyrene foam in between the frame members. The web portions of each of the frame members can also include openings to permit plumbing, electrical wiring, ductwork or other building utilities to run through the support system.

A shear connector is secured to the top chord of each joist assembly and extends the entire length thereof. The shear connector extends vertically upwards from the top chord of the joist, having an arcuate end or bend. This bend provides additional surface area to which the concrete layer may bond and can be used to stiffen the shear connector. The shear connector also includes a plurality of openings that also provide additional surface area of contact between the shear connector and the concrete layer, further strengthening the resulting steel-concrete composite flooring system. The shear connector can include attachment portions including downwardly extending tabs for engaging slots provided in the top chord of the joist assembly. By providing a shear connector with attachment tabs and a top chord with corresponding attachment slots, the time it takes to assemble the joist and shear connector members is minimized.

The system may also include a method for supporting a concrete floor by providing at least two joist assemblies, as described above, and each having a shear connector secured to the top chord thereof, and permanently securing at least one foam panel between a pair of adjacent joist assemblies. The method can include forming a composite floor of the present invention by additionally pouring a layer of concrete over the foam panel and to a height above the top of the shear connector.

The composite floor system and methods for supporting a concrete floor eliminate the need for reinforcement provided within the concrete layer, such as rebar, metal mesh or cross braces, thus rendering the system lighter, easier to install and less expensive. In addition, without the necessity to reinforce the concrete, the concrete layer is more suitable for installation of radiant heating systems. Furthermore, construction processes are simplified because cross blocking, special tools and skills required for framing the system during the curing period are not require due to the reduced weight of the system, and the drilling and cutting associated with traditional wood products are all unnecessary. Further, the system provides a composite concrete floor that does not require framing material to be removed, significantly shortening set up and construction time.

The composite concrete floor support systems disclosed herein have all the advantages of concrete flooring system, such as strength, rigidity, durability, mold resistance and sound attenuation, with the added benefit of utilizing a foam insulation layer to provide a durable and energy-efficient construction. Because of benefits, such as sound attenuation, impact resistance, and high R-value, the foam layer enhances the advantages of the concrete decking to provide a lighter, more durable composite system over traditional composite concrete flooring systems.

A composite flooring system and method for supporting a concrete flooring system in accordance with a second embodiment of the present invention can be used in situations where conventional wood, masonry, or light gauge steel framing materials are used. The system includes a plurality of joist assemblies arranged in a spaced apart and substantially parallel configuration, with a deck panel supported between each pair of adjacent joist assemblies, and a concrete layer provided over the deck panel.

The joist assembly preferably includes a male frame member, a female frame member, a plurality of top joist clips and a plurality of bottom joist clips. The male frame member includes a bottom male flange support, a top flange support and a plurality of male substantially triangular openings. A male middle flange extends from a top leg of each male triangular opening. A first flange extends from a first angled leg of the male triangular opening and a second flange extends from a second angled leg of the male triangular opening. The female frame member includes a female bottom flange support, a top flange and a plurality of female substantially triangular openings. A female middle flange extends from a top leg of each female triangular opening. The female triangle is sized to receive the first and second flanges of the male triangle. The plurality of top joist clips are used to secure the male and female frame members together. The plurality of bottom joist clips are also used to secure male and female frame members together. A plurality of top and bottom support straps are used to secure adjacent joist assemblies to each other. A plurality of cross braces are also used to secure adjacent joist assemblies to each other. Plumbing, electrical wiring, ductwork or other building utilities may be run through the plurality of male and female triangular openings. The male and female middle flanges are used to support a deck panel. Concrete is poured on a top of the deck panels. An exterior insulating finishing system may be attached to the concrete, while the concrete is still wet to form a composite wall system.

The second embodiment of the composite floor system and methods for supporting a concrete floor eliminates the need for reinforcement provided within the concrete layer, such as rebar, metal mesh or cross braces, thus rendering the system lighter, easier to install and less expensive. In addition, without the necessity to reinforce the concrete, the concrete layer is more suitable for installation of radiant heating systems. Furthermore, construction processes are simplified because cross blocking, special tools and skills required for framing the system during the curing period are not require due to the reduced weight of the system, and the drilling and cutting associated with traditional wood products are all unnecessary. Further, the system provides a composite concrete floor that does not require framing material to be removed, significantly shortening set up and construction time.

The second embodiment of the composite concrete floor support systems disclosed herein has all the advantages of concrete flooring system, such as strength, rigidity, durability, mold resistance and sound attenuation, with the added benefit of utilizing a foam insulation layer to provide a durable and energy-efficient construction. Because of benefits, such as sound attenuation, impact resistance, and high R-value, the foam layer enhances the advantages of the concrete decking to provide a lighter, more durable composite system over traditional composite concrete flooring systems Various other features, objects, and advantages of the invention will be made apparent to those skilled in the art from the accompanying drawings and detailed description thereof.

DETAILED DESCRIPTION OF THE PREFERRED EMBODIMENTS

Figure 1:
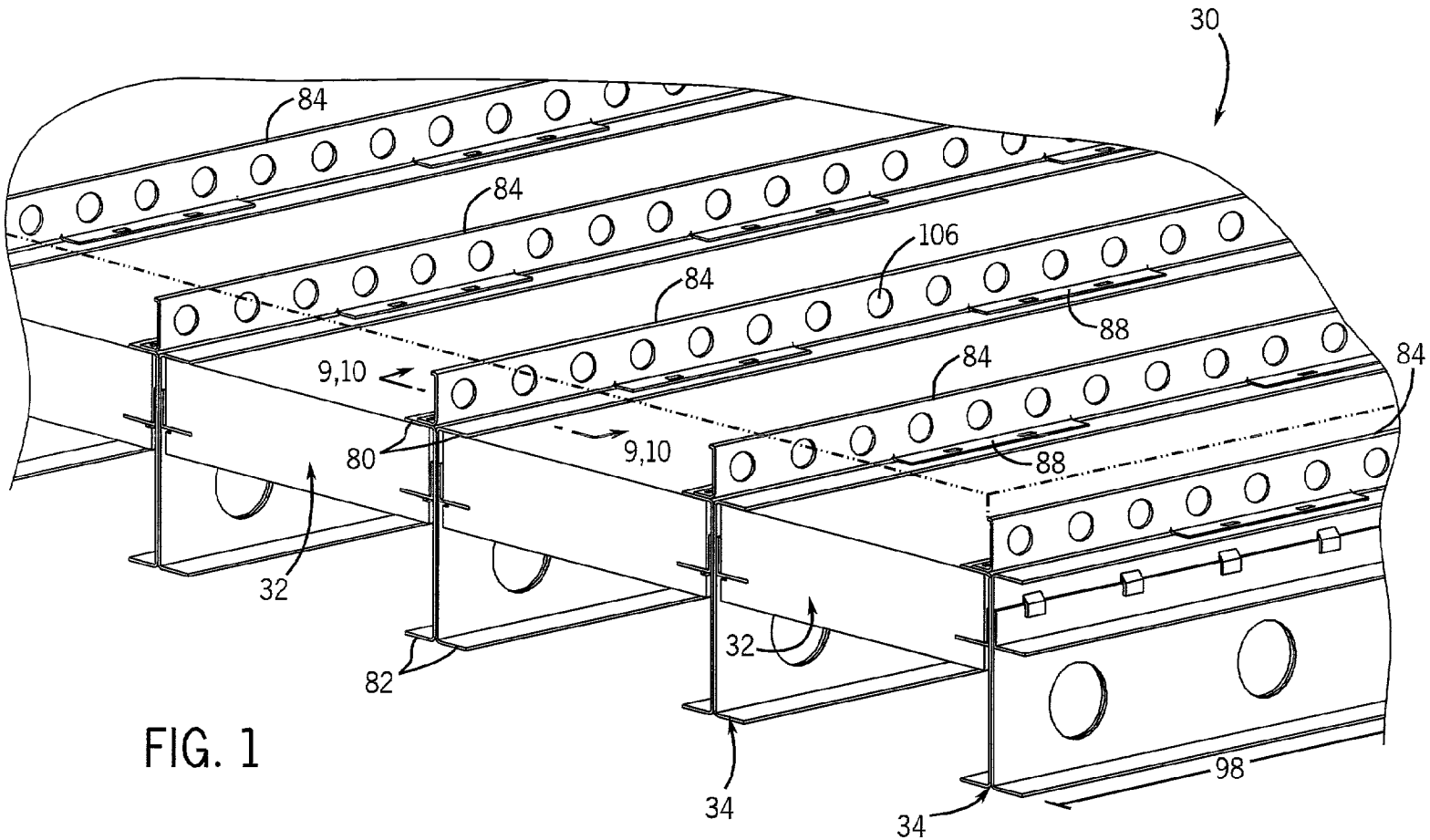
FIG. 1 is a perspective view of a composite floor system of the present invention, with a concrete layer shown in shadow.

FIGS. 1 through 10 illustrate one embodiment of a system 30 for supporting a concrete deck or concrete floor in accordance with the present invention. In its simplest form, the floor support system 30 includes at least one panel 32, supported between at least one pair of joist members or assemblies, indicated generally at 34, and a concrete layer 35. As will be readily apparent from the following description, the floor support system is not limited to any particular construction application and can be utilized in grade level or above-grade projects, and in both small and large flooring and/or roofing projects. In addition, the floor support system 30 is compatible with a number of different shoes, hangers and/or connectors, ensuring the system is properly secured to primary structural members such as walls, primary girders, beams, trusses or foundation members, as will be recognized by those skilled in the art.

Turning first to FIGS. 1-4, each joist assembly 34 comprises first and second C-shaped channel or frame members 36 and 38, respectively, of mirror image construction, arranged in a back-to-back fashion. The channel member 36 includes a top flange 40, a bottom flange 42 and a web portion 44 therebetween. Likewise, the channel member 38 includes a top flange 46, a bottom flange 48 and a web portion 50. The channel members are preferably constructed of steel, but other metals, alloys, composite materials or any material of sufficient strength as determined by required engineering standards may be used to form the channel members 36 and 38.

Figure 3:
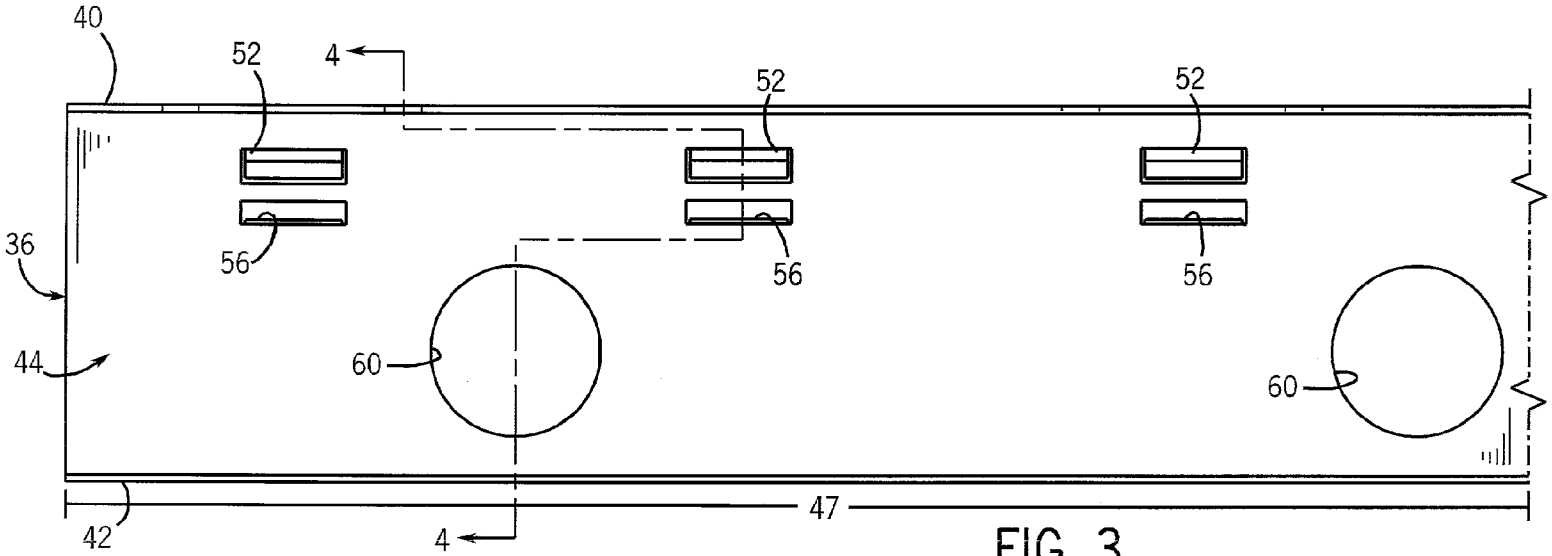
FIG. 3 is a partial side view of a channel member used in constructing the joist assembly illustrated in FIG. 2.
Figure 5:
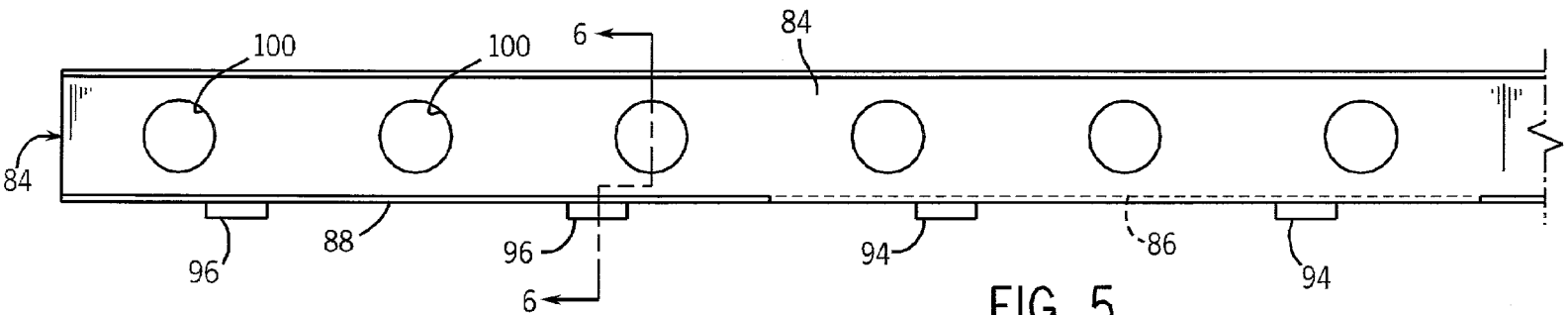
FIG. 5 is a partial side view of a shear connector used in the composite floor system illustrated in FIGS. 1 and 2.
Figure 4:
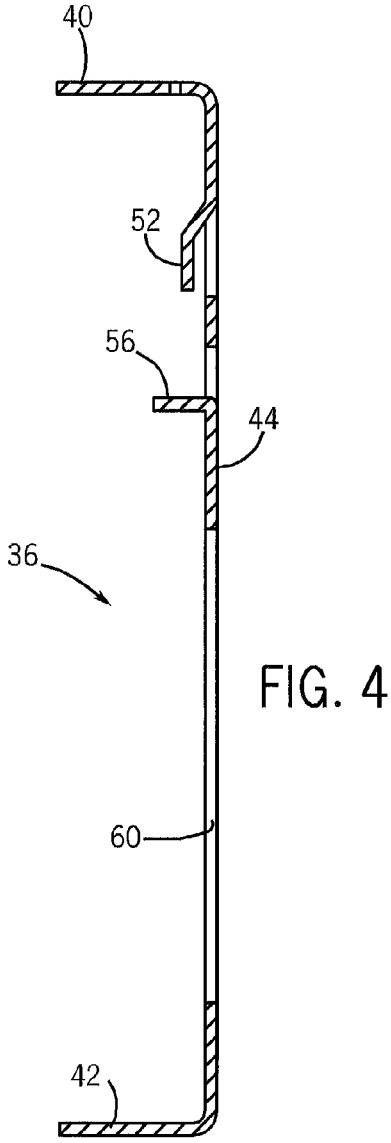
FIG. 4 is a sectional view of the channel member illustrated in FIG. 3, taken along the line 4.

The web portion 44 of the channel member 36 includes a plurality of clips 52 and corresponding tabs 56. The clips 52 are located near the top of the web portion 44 and are spaced apart along the length 47 of the channel member 36. As best illustrated in FIG. 3, each of the tabs 56 is vertically aligned with one of the clips 52 for retaining a support angle 59 (shown in FIGS. 7, 9 and 10). The clips 52 and tabs 56 can be stamped or punched within the web portion 44, leaving an aperture within the web, or alternatively, the clips and the tabs can be secured to or otherwise provided within the web portion.

The support angle 59 includes a leg 66 that is inserted into the clips 52 and a leg 68 that rests on the tabs 56, securing the support angle 59 along the length of the channel 36. The legs 66 and 68 may further be secured to the channel member 36 by welding or using screws, rivets, pins or another fastener that secures the support angle in place.

Similarly, the web portion 50 of the channel member 38 includes a plurality of clips 54 and corresponding tabs 58. The clips 54 are located near the top of the web portion 50 and are spaced apart along the length 49 of the channel member 38. Each of the tabs 58 is vertically aligned with one of the clips 54 for retaining a support angle 61 (shown in FIGS. 7, 9 and 10). The clips 54 and tabs 58 can be stamped or punched within the web portion 50, leaving an aperture within the web, or alternatively, the clips and the tabs can be secured to or otherwise provided within the web portion.

The support angle 61 includes a leg 70 that is inserted into the clips 54 and a leg 72 that rests on the tabs 58, securing the support angle 61 along the length of the channel 38. The legs 70 and 72 may further be secured to the channel member 38 by welding or using screws, rivets, pins or another fastener that secures the support angle in place.

It will be appreciated by those skilled in the art that the clips and tabs provided within the web portions of each of the channel members may be replaced by another support mechanism that adequately retains the support angles in place. Such a mechanism can include using screws, rivets, pins or alternatively by welding the support angle to the channel members.

The web portions 44 and 50 of each of the channel members 36 and 38 also include a plurality of apertures 60 and 62, respectively, to permit plumbing, electrical wiring, ductwork or other building utilities to run through the support system. As will be recognized by those skilled in the art, the size of the channel members 36 and 38, including but not limited to, the span of their corresponding web portions 44 and 50, the number of clips 52 and tabs 56 provided, and the size and number of apertures 60 and 62 provided within the web portions 44 and 50, will depend on the given construction application, and is determined by, among other factors, the span of the flooring system to be installed, loading considerations of the floor, use and location of the building and applicable ANSI, ASTM, and/or governmental design and safety standards.

Figure 2:
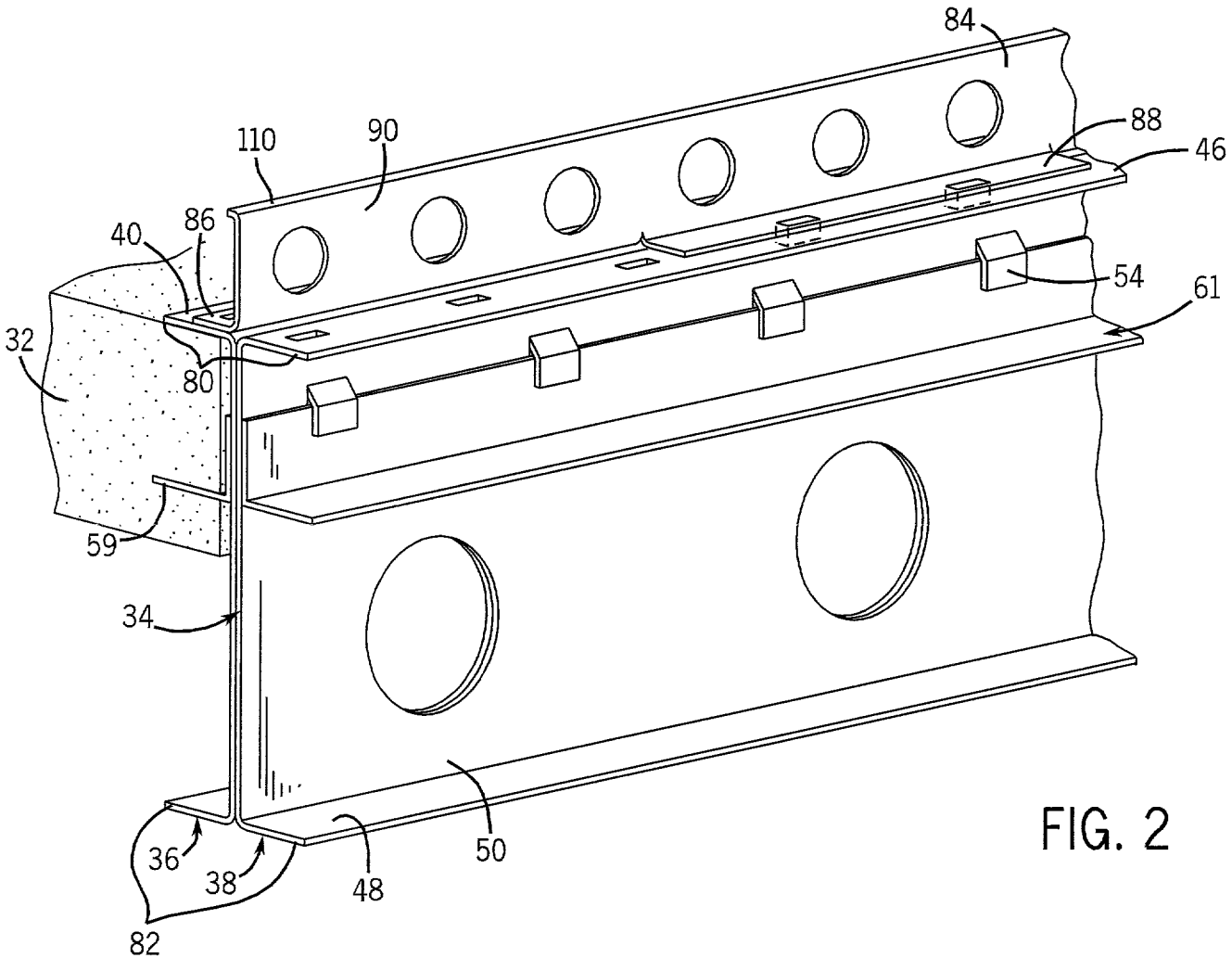
FIG. 2 is a partial perspective view of a joist assembly for use in the composite floor system illustrated in FIG. 1.
Figure 9:
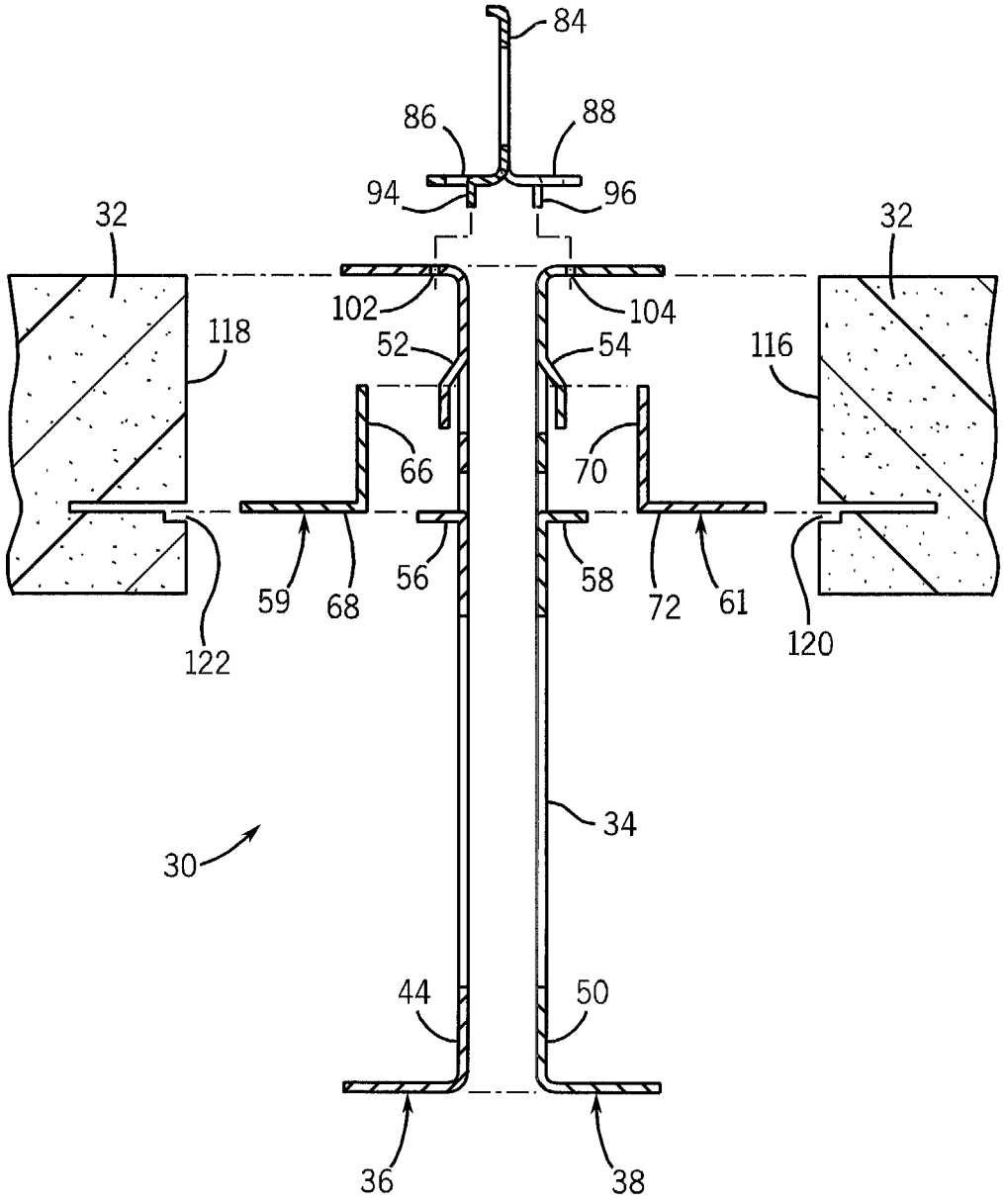
FIG. 9 is an exploded side view of the composite floor system illustrated in FIGS. 1 and 2, illustrating construction of the joist assembly and panel components.
Figure 10:
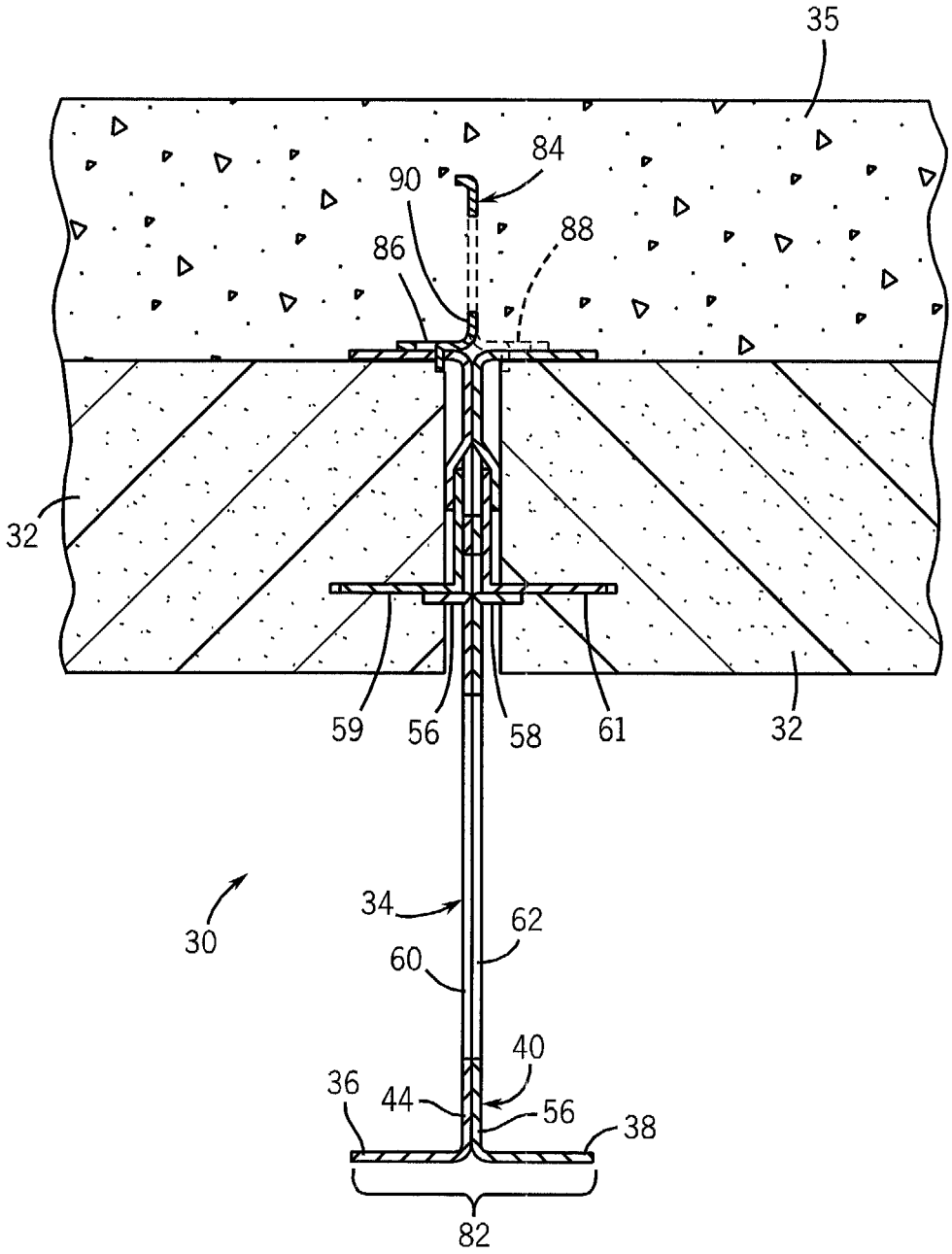
FIG. 10 is a side view of the composite floor system illustrated in FIGS. 1, 2 and 9, illustrating the joist assembly and foam panel components, and including a layer of concrete, completing the composite floor system.

As best illustrated in FIGS. 2, 9 and 10, the joist assembly 34 is formed by arranging the channel members in a back-to-back fashion. The top flange 40 of the channel member 36 is horizontally aligned with the top flange 46 of the channel member 38, forming top chord 80 of the joist assembly 34. The bottom flange 42 of the channel member 36 is horizontally aligned with the bottom flange 48 of the channel member 38, forming bottom chord 82 of the joist assembly 34. As illustrated in the Figures, in this arrangement, the web portions 44 and 50 of the channel members are aligned and apertures 60 and 62 along the length of each of the channel members are also aligned.

It will be appreciated from FIG. 10, that the joist assembly 34 includes a two-layered or reinforced web comprising both the web portions 44 and 50. Once positioned in this manner, the channel members 36 and 38 can be secured together, if required, by welding or using bracket, screws, clips, rivets, pins or another fastener.

Figure 6:
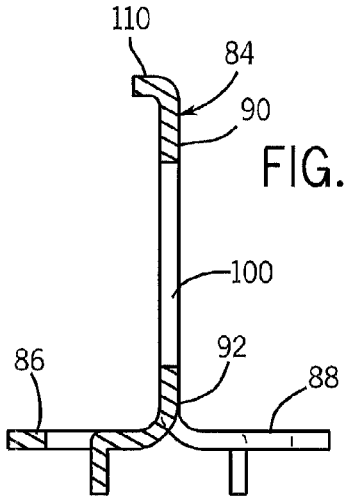
FIG. 6 is a sectional view of the shear connector illustrated in FIG. 5, taken along the line 5.
Figure 7:
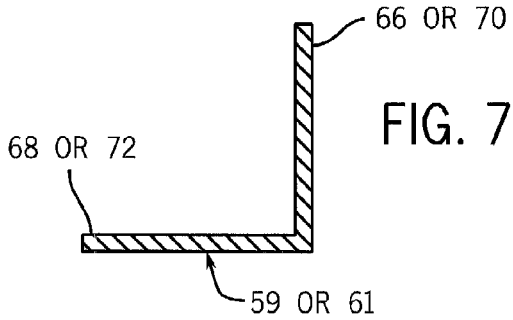
FIG. 7 is an end view of a support angle used in constructing the joist assembly illustrated in FIG. 2.

As best shown in FIGS. 1, 2, 9 and 10, a shear connector 84, is secured to the top chord 80 of each of the joist assemblies 34. The shear connector 84 is preferably constructed of steel or another material capable forming a sufficient bond with the concrete layer 35, resulting in the required composite action/strength. As best illustrated in FIG. 6, the shear connector 84 extends the entire length of each of the joist assemblies, and has a substantially vertical portion, indicated generally at 90, and a plurality of attachment portions, indicated generally at 86 and 88, extending horizontally away from the bottom 92 of the vertical portion 90.

The attachment portions 86 and 88 are short, substantially planar members formed on alternating sides of the vertical portion 90. Each of the attachment portions 84 and 86 includes downwardly extending tabs 94 and 96, respectively, for engaging the top chord 80 of the joist assembly 34. In particular, the top chord 80 is provided with a plurality of spaced apart slots 102 and 104 (shown in FIG. 9) for receiving the tabs 94 and 96, respectively, on each of the alternating attachment portions 84 and 86. Once positioned in this manner, the tabs 94 and 96 may be secured within the slots 102 and 104, if required, by using adhesives or welds, or using fasteners, such as screws, clips, rivets or pins. Although the attachment portions 84 and 86 are illustrated having two tabs on each segment, it will be recognized that more than two tabs may be provided, and a corresponding number of slots will be provided within the top chord 80 of the joist assembly 34.

The vertical portion 90 of the shear connector 84 includes an arcuate end or bend 110 located at the top thereof. This bend 110 can be used to stiffen the vertical portion 90 of the shear connector and also provides additional surface area to which the concrete layer 35 may bond. The bend 110 can be formed in either direction, as is not limited to the direction indicated in FIG. 6. Consistent with the broader aspects of the present invention, the bend 110 can be replaced with another extension or protuberance that provides at least the same amount of contact surface area for bonding with the concrete layer 35. In addition, the vertical portion 90 also includes a plurality of openings 100 formed along the length 98 of the shear connector 84. These openings also provide additional surface area of contact between the shear connector 84 and the concrete, further strengthening the resulting steel-concrete composite flooring system.

Figure 8:
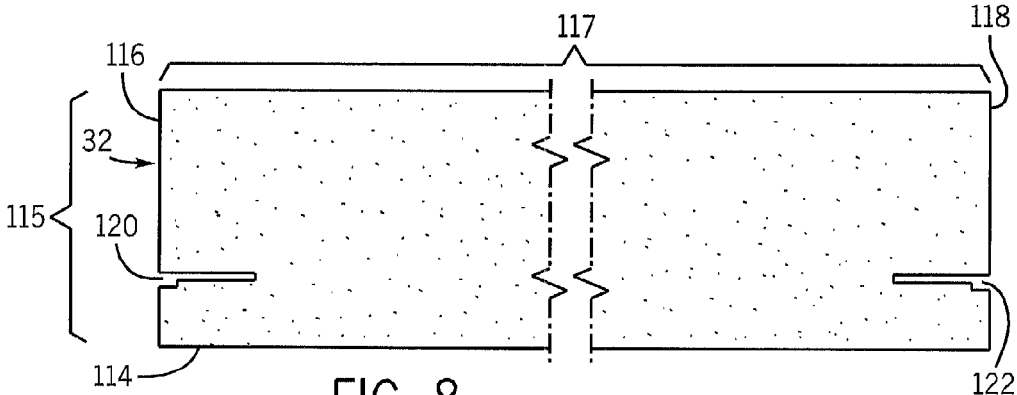
FIG. 8 is a partial side view of a forming panel used in the composite floor system illustrated in FIGS. 1 and 2.

Turning now to FIG. 8, and with reference to FIGS. 1, 9 and 10, each panel 32 is a substantially planer member, having top and bottom surfaces 112 and 114, respectively, a thickness 115 and opposing ends 116 and 118. The ends of each of the panels 32 are configured to be supported by the support angles 61 and 59 between two adjacent joist assemblies 34, as best illustrated in FIG. 1. Preferably, each end 116 and 118 is provided with a notch or groove 120 and 122, respectively, for receiving at least a portion of each of the adjacent support angles 61 and 59. The panel 32 is preferably constructed of polystyrene or polyisocyanurate insulation foam, however, plywood, oriented strand board or particle board may also be used. The size of the panels 32, including the length, thickness 115 and span 117 is determined by spacing of the joist assemblies 34, the material of panel 32 and applicable design standards, as recited herein.

Figure 11:
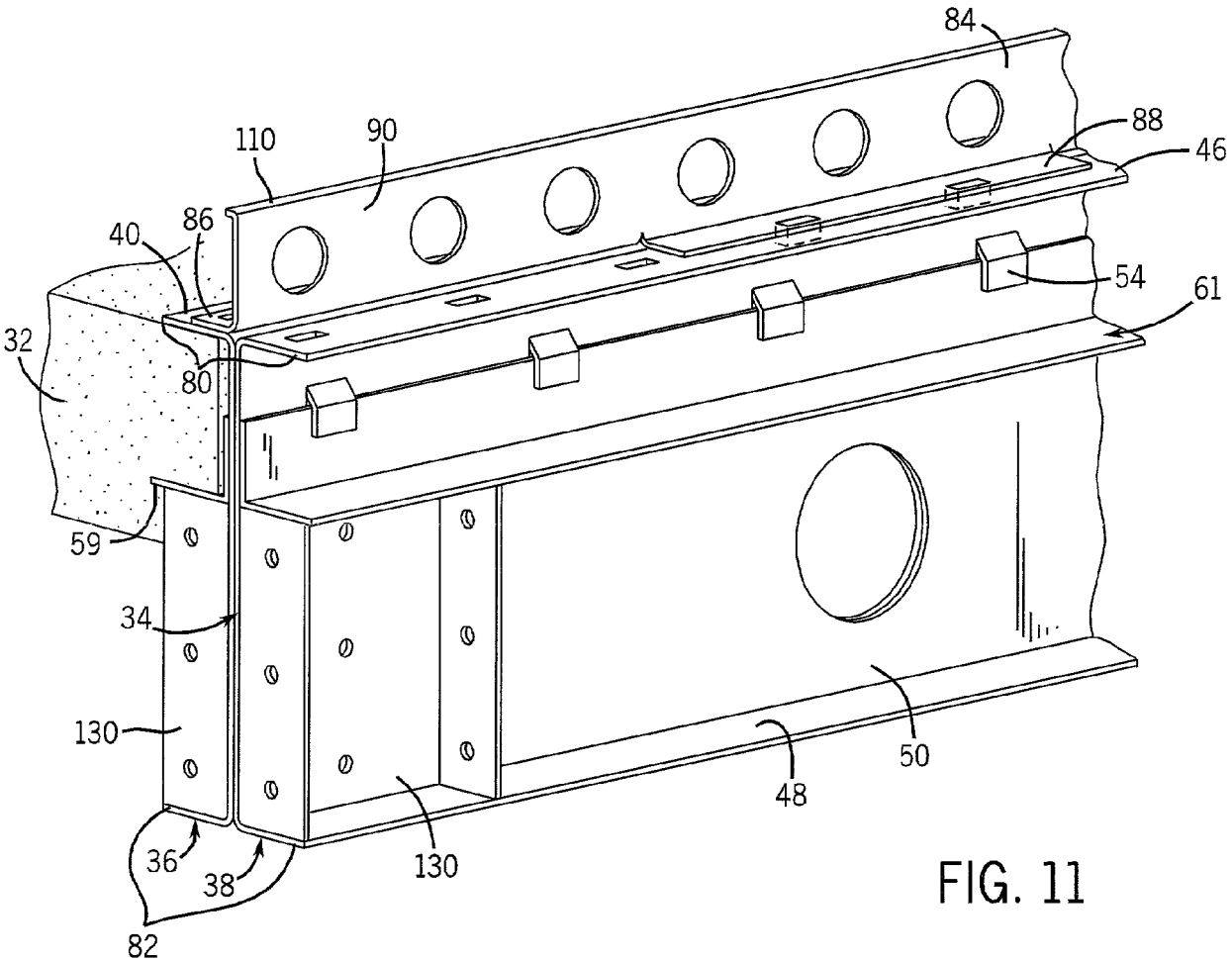
FIG. 11 is a perspective view of an alternative embodiment of a joist assembly for use in a composite floor system.

An alternative embodiment of the present invention is shown in FIG. 11. In this embodiment, stiffeners 130 are incorporated at the ends of a joist 34. The stiffeners 130 extend in a vertical direction between the top 80 and bottom 82 chords of the joists 34, and the legs of the stiffeners 130 may be bolted or otherwise secured to the joists 34. The stiffeners 130 provide increased stiffness an reinforcement at the ends of the joists 34.

As illustrated in FIGS. 8-9, and also in FIGS. 1 and 10, the composite flooring system 30 of the present invention is constructed by providing at least two joist assemblies 34, each having a shear connector 84 secured to the top chord 80 thereof, and securing the panel 32 between the joist assemblies by inserting the leg 68 of the support angle 59 into the groove 122 on the end 118 of the panel 32, and by inserting the leg 72 of the support angle 61 into the groove 120 on the end 116 of an adjacent panel 32. The panels 32 may be additionally secured to each joist member using an adhesive, such as epoxy or a polymeric adhesive, sufficient to securely bond the panel 32 to the joist assembly 34.

The concrete layer 35 is poured on top of the panels 32, to a height above the bend 110 in the shear connector 84. The panels 32 remain in place after the concrete layer cured. The amount of concrete utilized, and therefore the height of the concrete layer is determined, at least in part, by the particular type of concrete utilized, the particular construction application, the ultimate live and dead loads, including the weight of additional flooring, the size of the joist assemblies utilized, and the type of panel selected. It will be appreciated that materials other than concrete, such as concrete-fiberglass composites, or treated concrete materials can be used for the layer 35.

It can be seen that the composite floor system 30 and methods of the present invention provides a lighter and compact composite floor support system compared to conventional composite systems by eliminating the need for concrete reinforcement. By including foam panels 32 that remain in place after construction of the system, in combination with a joist assembly 34 that includes a reinforced web portion (the web portions 44 and 50 of the channel members) and a shear connector 84 provided with a plurality of openings 100 to increase the surface area for contact with the concrete layer, the composite system of the present invention does not require use of rebar or other concrete reinforcements. Without regard to any particular theory or mode of installation, the present invention provides a composite system 30 that utilizes a novel construction, allowing the concrete 35 and foam panels 32 to act as a compression flange, distributing horizontal shear forces from the slab to the primary structural members. As such, by eliminating the need for concrete reinforcement, the present invention can provide a less expensive and easier to assemble system.

FIGS. 12 through 30 illustrate a second embodiment of a composite floor system 200 for supporting a concrete deck or concrete floor in accordance with the present invention. Preferably, the floor support system 200 includes at least one deck panel, supported between at least one pair of joist assemblies and a concrete layer.

Figure 12:
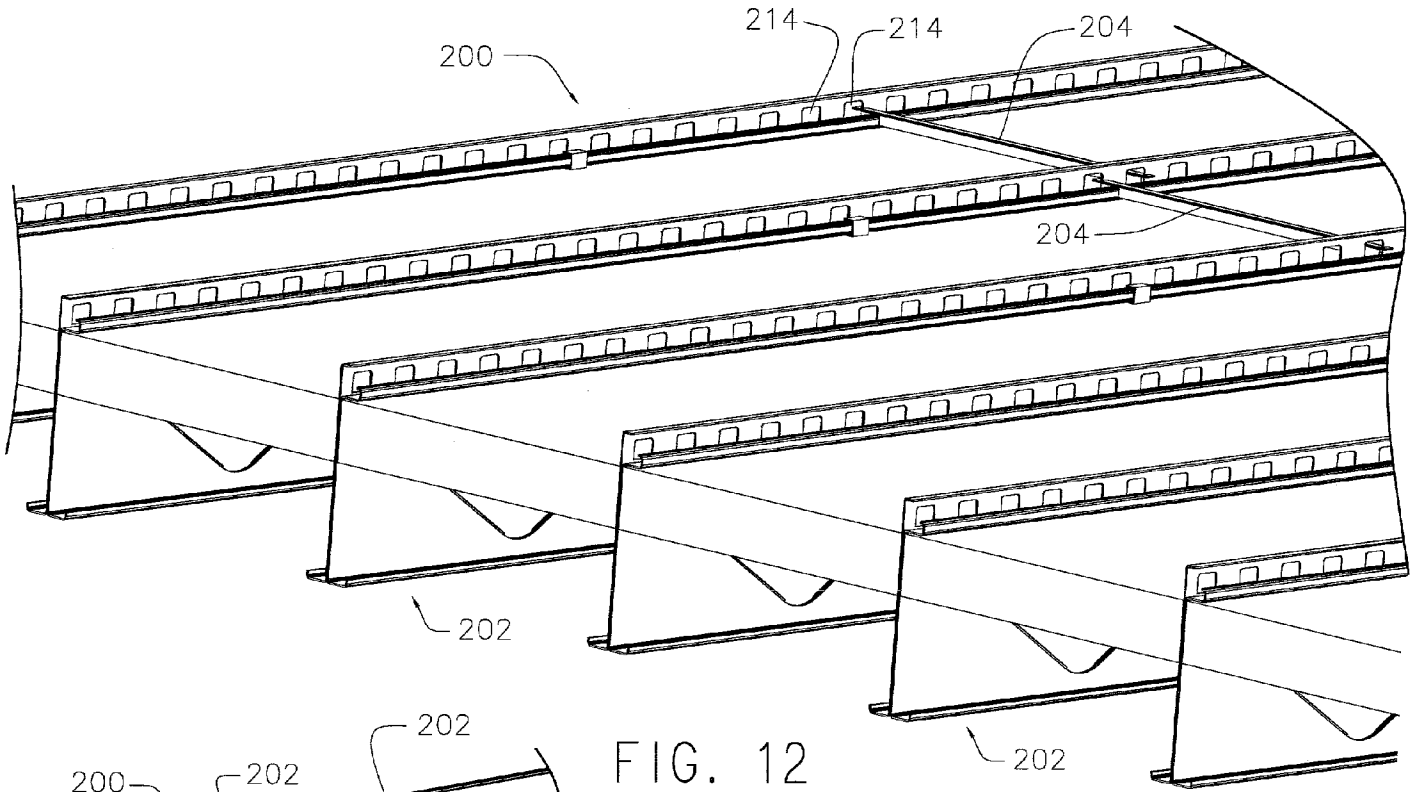
FIG. 12 is a perspective view of a second embodiment of a composite floor system.
Figure 13:
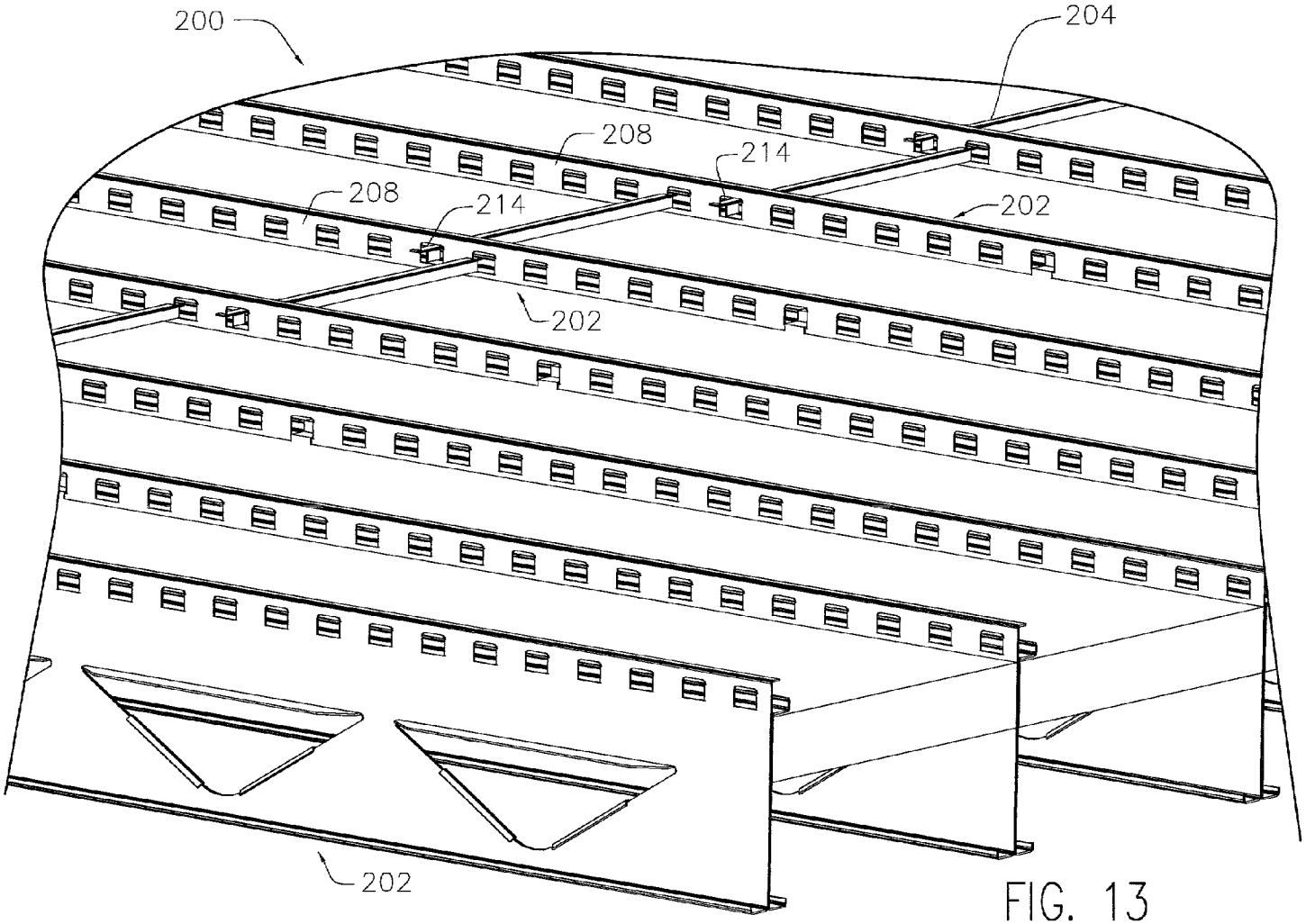
FIG. 13 is a perspective view of a second embodiment of a composite floor system illustrating a plurality of staggered top straps.
Figure 26:
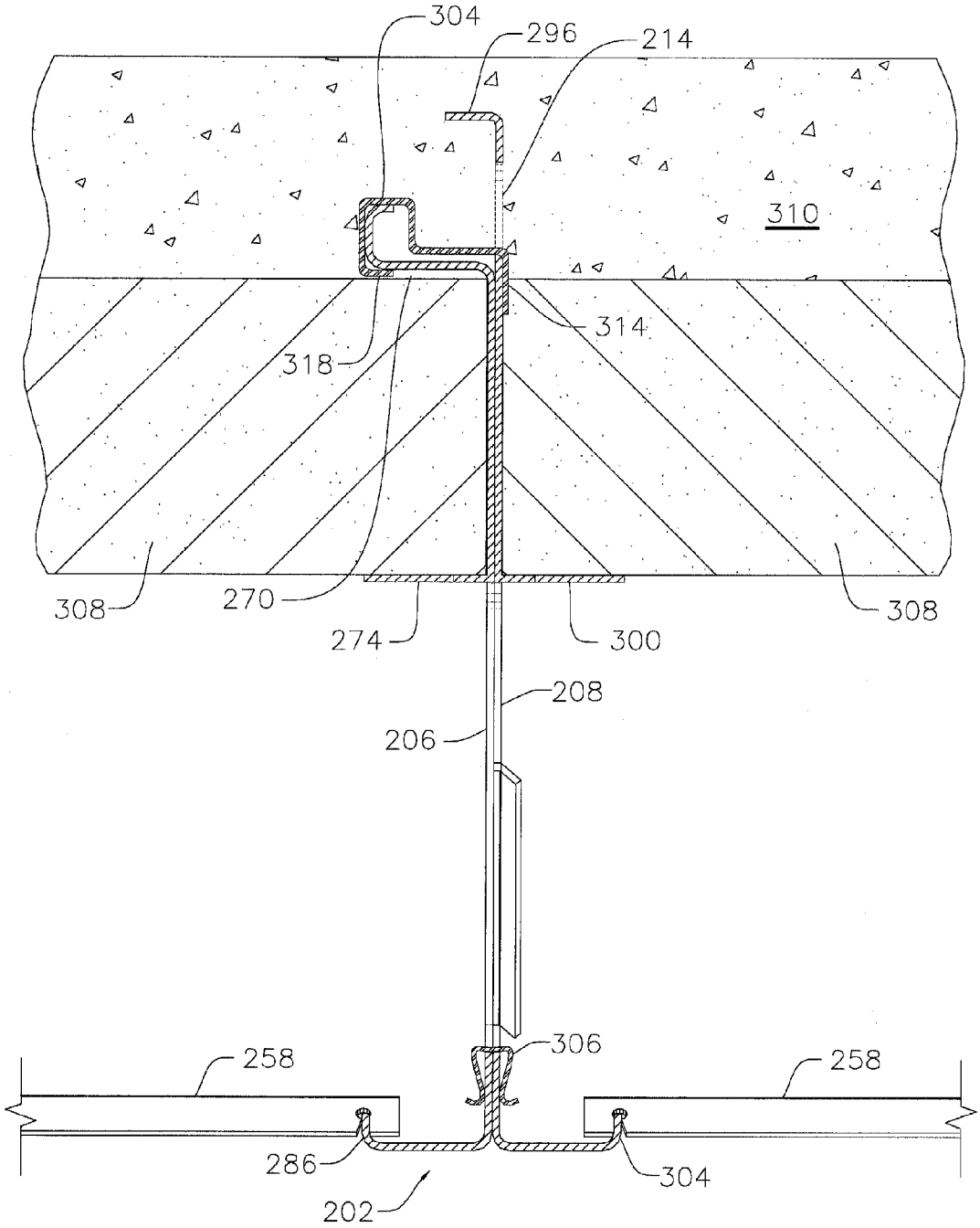
FIG. 26 is an end view of a second embodiment of a composite floor system.
Figure 27:
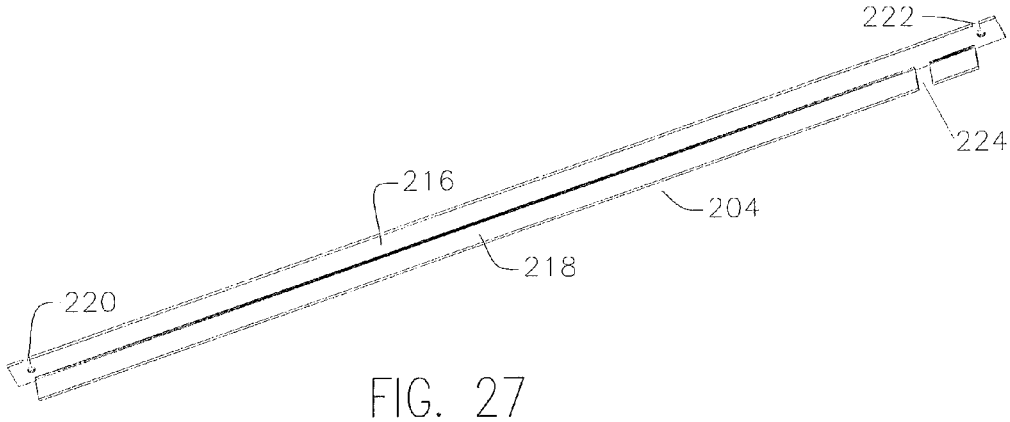
FIG. 27 is a perspective view of a top strap of a second embodiment of a composite floor system.

With reference to FIGS. 12, 13 and 26, the composite floor system 200 includes a plurality joist assemblies 202 and a plurality of top straps 204. Each joist assembly 202 includes a male frame member 206, a female frame member 208, a plurality of top joist clips 210 and a plurality of bottom joist clip 212. A plurality of shear connector openings 214 are formed through each female joist member 208. With reference to FIG. 27, each top strap 204 includes a first top flange 216 extending from a second top flange 218. A first slot 220 is formed in one end of the first top flange 216 to receive a thickness of the female frame member 208 and a second slot 222 is formed in the other end of the first top flange 216 to receive a thickness of an adjacent female frame member 208. A clearance slot 224 is formed in the second top flange 218 at substantially the second end to provide clearance for a top support flange 270 of the male frame member 206. Adjacent top straps 204 must be staggered relative to each other.

Figure 14:
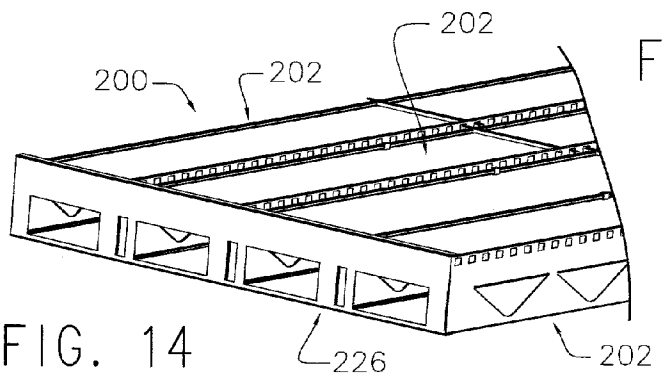
FIG. 14 is a perspective view of a second embodiment of a composite floor system terminated with an end track.
Figure 15:
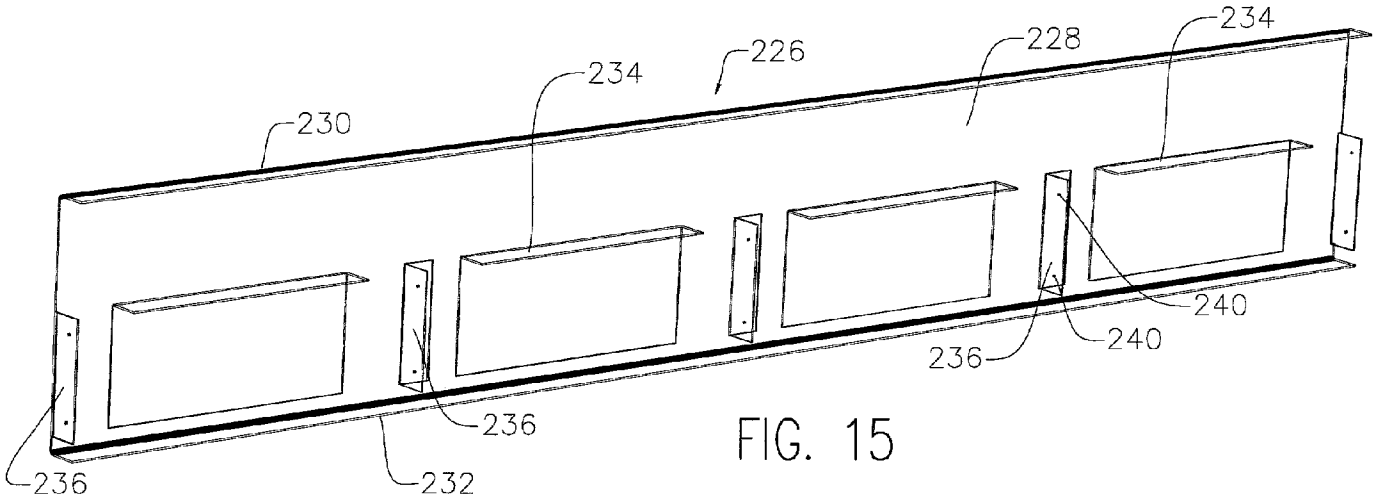
FIG. 15 is a rear perspective view of an end track of a second embodiment of a composite floor system.
Figure 16:
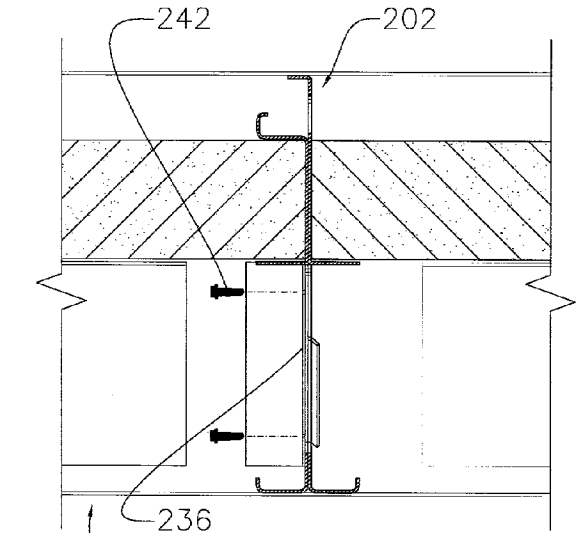
FIG. 16 is an end view of an end track before assembly to a joist assembly of a second embodiment of a composite floor system.
Figure 17:
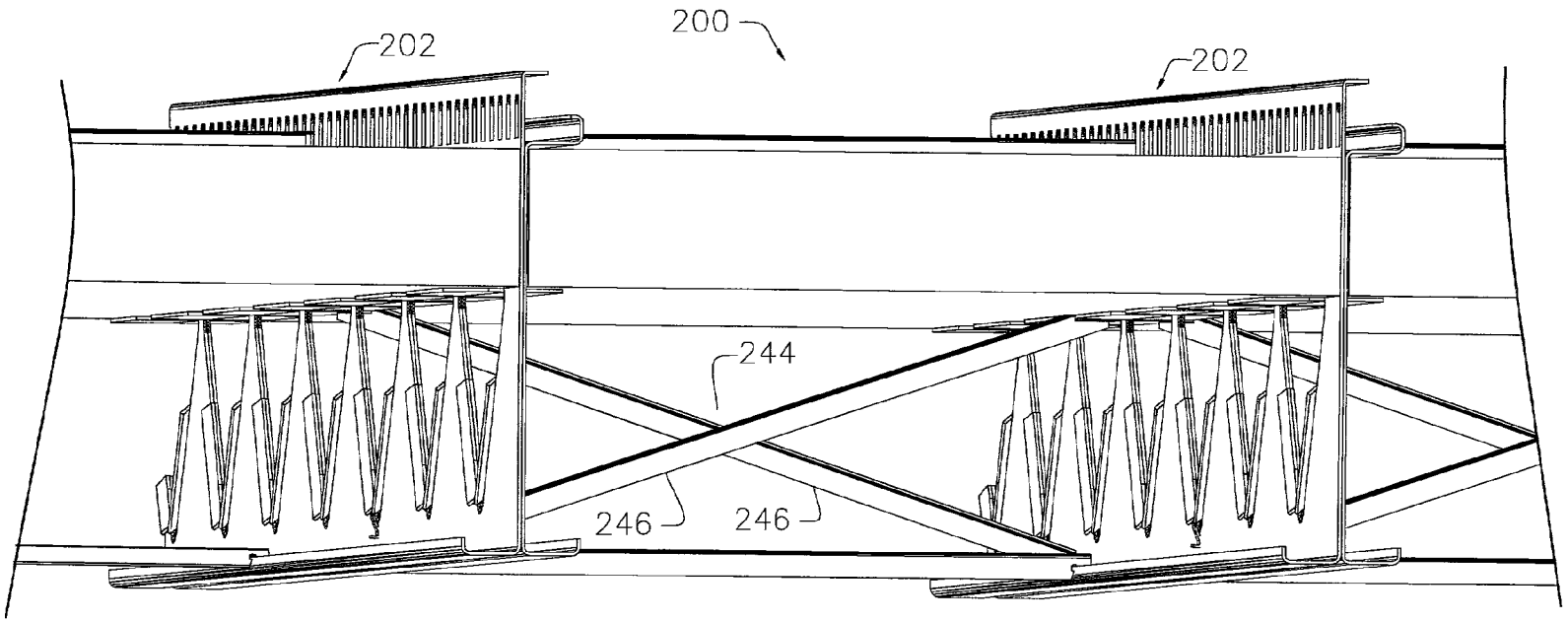
FIG. 17 is a perspective view of a second embodiment of a composite floor system with a cross brace.
Figure 18:
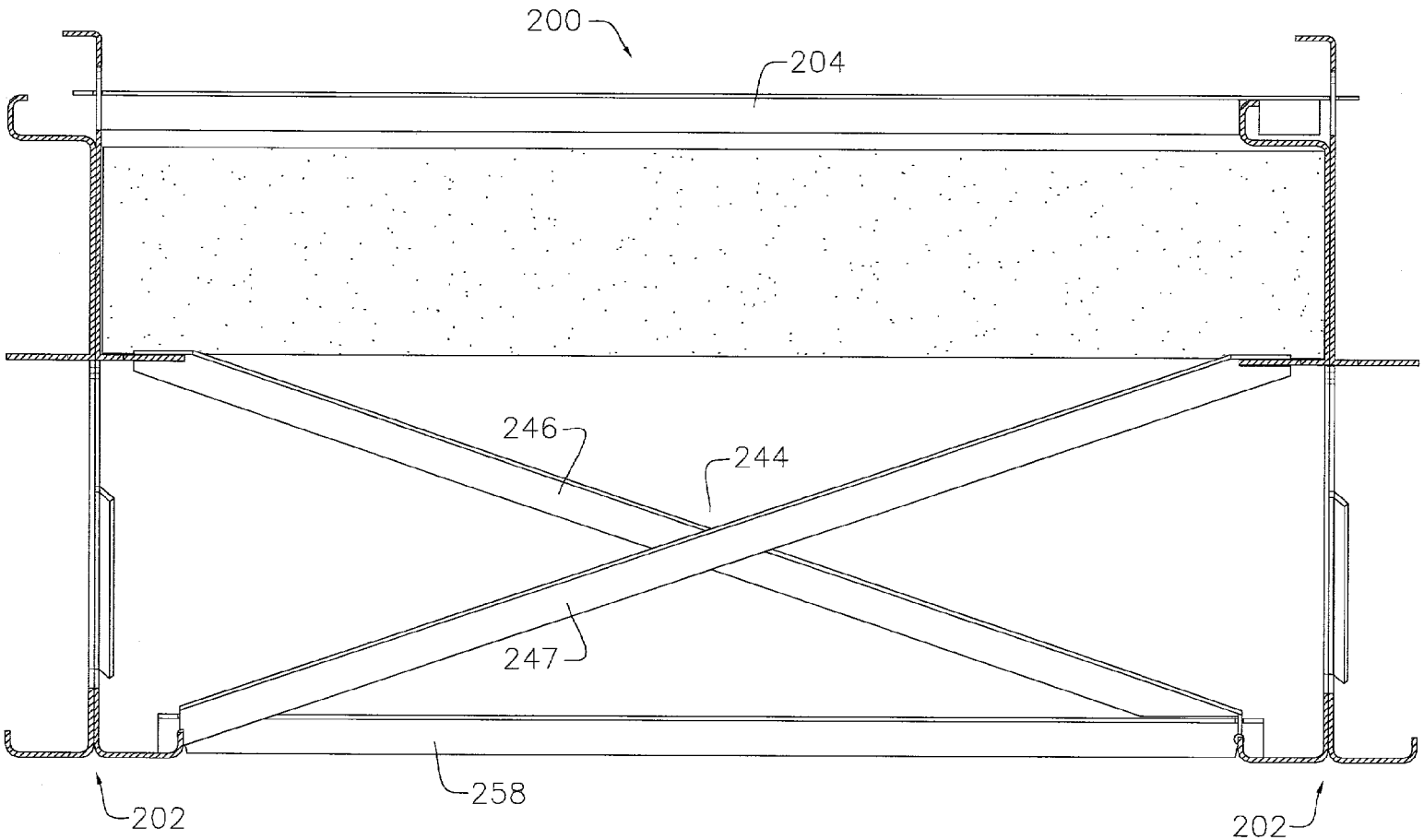
FIG. 18 is a front view of a second embodiment of a composite floor system with a cross brace.
Figure 19:
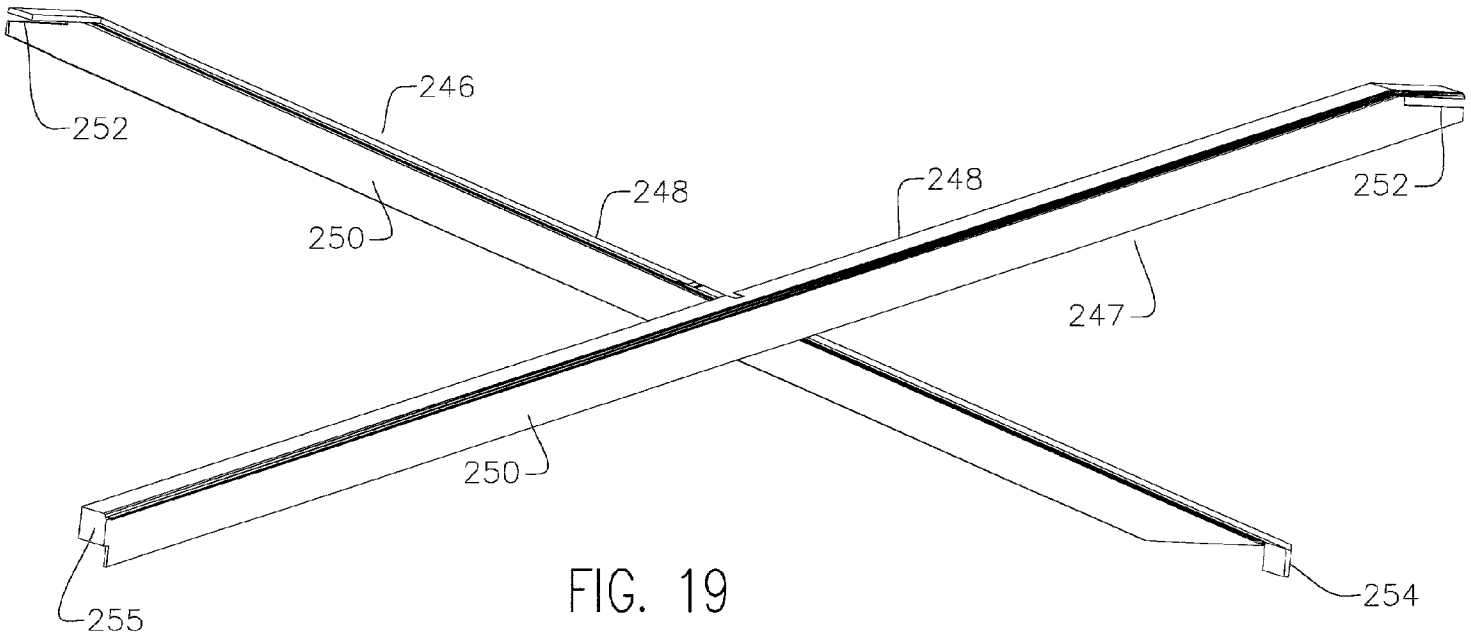
FIG. 19 is a front view of a cross brace before assembly of a second embodiment of a composite floor system.
Figure 20:
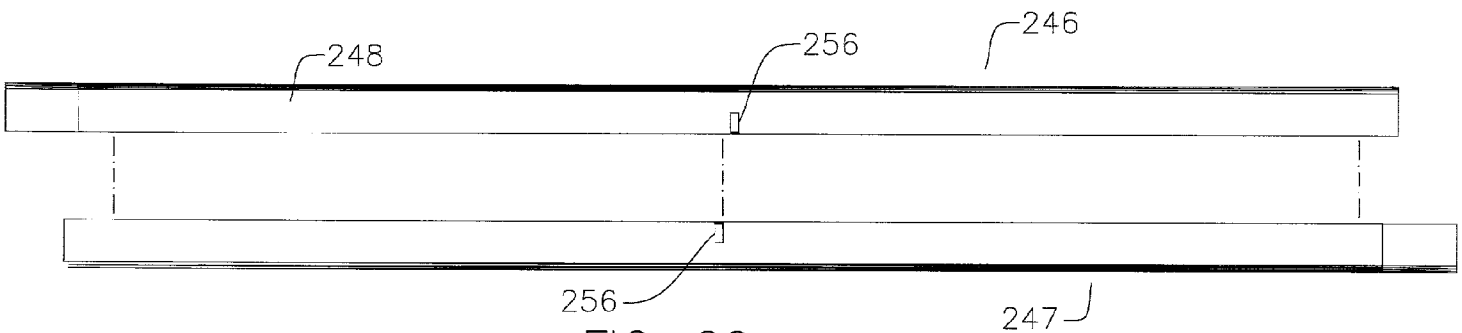
FIG. 20 is a top view of a cross brace before assembly of a second embodiment of a composite floor system of featuring a cross brace.

With reference to FIGS. 14-16, an end track 226 terminates an end of the plurality of joist assemblies 202. The end track 226 includes a base plate 228, an upper flange 230, a lower flange 232, a plurality of deck support flanges 234 and a plurality of attachment tabs 236. The upper flange 230 extends from a top of the base plate 228 and the bottom flange 232 extends from a bottom of the base plate 228. The plurality of deck support flanges 234 extend from a top perimeter of a plurality of deck openings 238 formed through the base plate 228. A pair of fastener holes 240 are preferably formed through each attachment tab 236 to receive a pair of threaded fasteners 242. The threaded fasteners 242 are used to secure the end track 226 to an end of the plurality of joist assemblies 202.

With reference to FIGS. 17-20, a cross brace 244 is used to secure a pair of adjacent joist assemblies 202 to each other. The cross brace 244 includes a first brace member 246 and a second brace member 247. The first and second brace members include a first flange 248 and a second flange 250 that extends from the first flange 250. An end slot 252 is formed in one end of the first and second brace members to receive a middle flange of the male or female frame members. A retention tab 254 is formed on the other end of the first brace member 246 for seducement to a bottom flange support of the male or female frame members. A retention tab 255 is formed on the other end of the second brace member 247 for seducement to a bottom flange support of the male or female frame members. A connection slot 256 is formed in a middle of the first and second brace members to allow assembly to each other.

Figure 28:
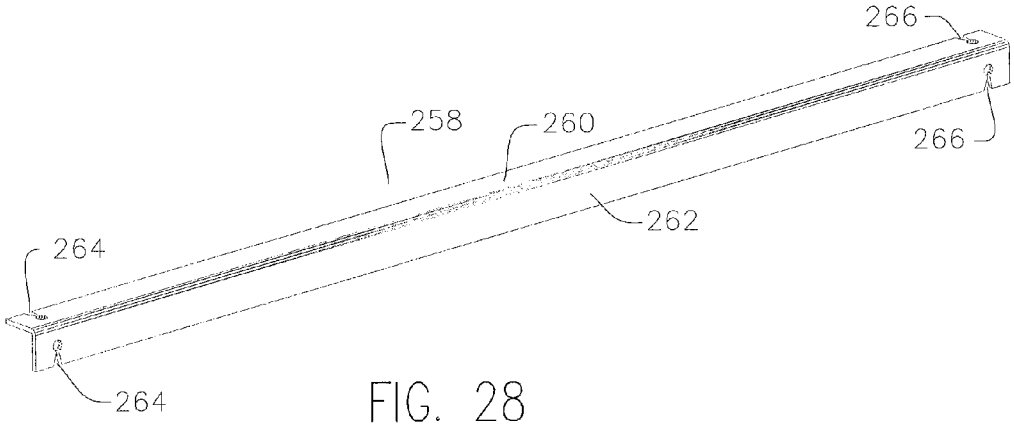
FIG. 28 is a perspective view of a bottom strap of a second embodiment of a composite floor system.
Figure 29:
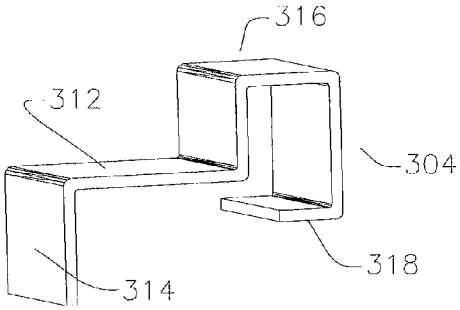
FIG. 29 is a perspective view of a top joist clip of a second embodiment of a composite floor system.
Figure 30:
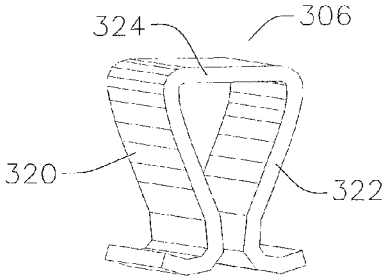
FIG. 30 is a perspective view of a bottom joist clip of a second embodiment of a composite floor system.

With reference to FIG. 28, a lower strap 258 includes a first flange 260 and a second flange 262. The second flange 262 extends from the first flange 260. A first slot 264 is formed in a first end of the first and second flanges and a second slot 266 is formed in a second end of the first and second flanges. One of the first slots 264 is sized to receive a thickness of a bottom flange support of the male or female frame members. One of the second slots 266 is sized to receive a thickness of a bottom flange support of the male or female frame members.

Figure 21:
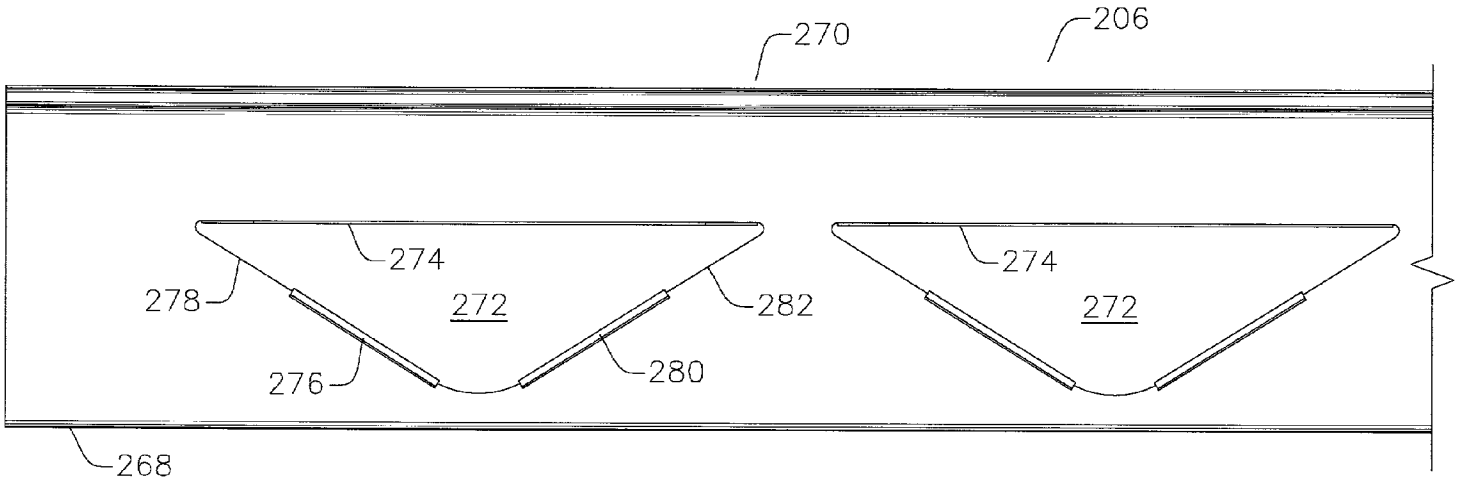
FIG. 21 is a inside view of a male joist member of a second embodiment of a composite floor system.
Figure 23:
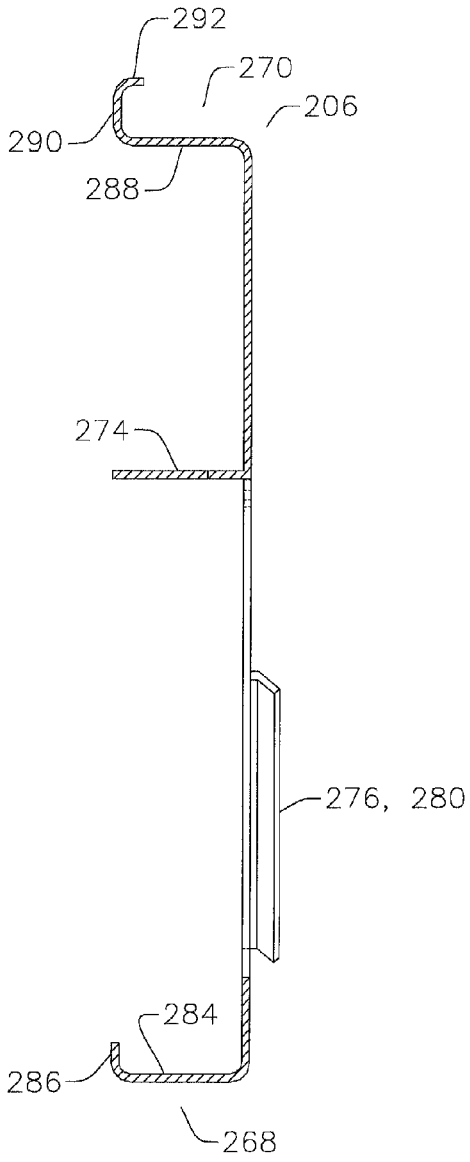
FIG. 23 is an end view of a male joist member of a second embodiment of a composite floor system.

With reference to FIGS. 21 and 23, the male frame member 206 includes a bottom flange support 268, a top flange support 270 and a plurality of substantially triangular openings 272. A middle flange 274 extends from a top leg of each triangular opening 272. A first flange 276 extends from a first angled leg 278 of the male triangular opening 272 and a second flange 280 extends from a second angled leg 282 of the male triangular opening 272. The bottom flange 268 terminates a bottom of the male frame member 206. The bottom flange support 268 includes a bottom flange 284 and an attachment member 286 that extends substantially perpendicular from the bottom flange 284. The top flange 270 terminates a top of the male frame member 206. The top support flange 270 includes a top member 288, a side member 290 and an extension member 292. The side member 290 extends substantially perpendicular from the top member 288 and the extension member 292 extends substantially perpendicular from the side member 290.

Figure 22:
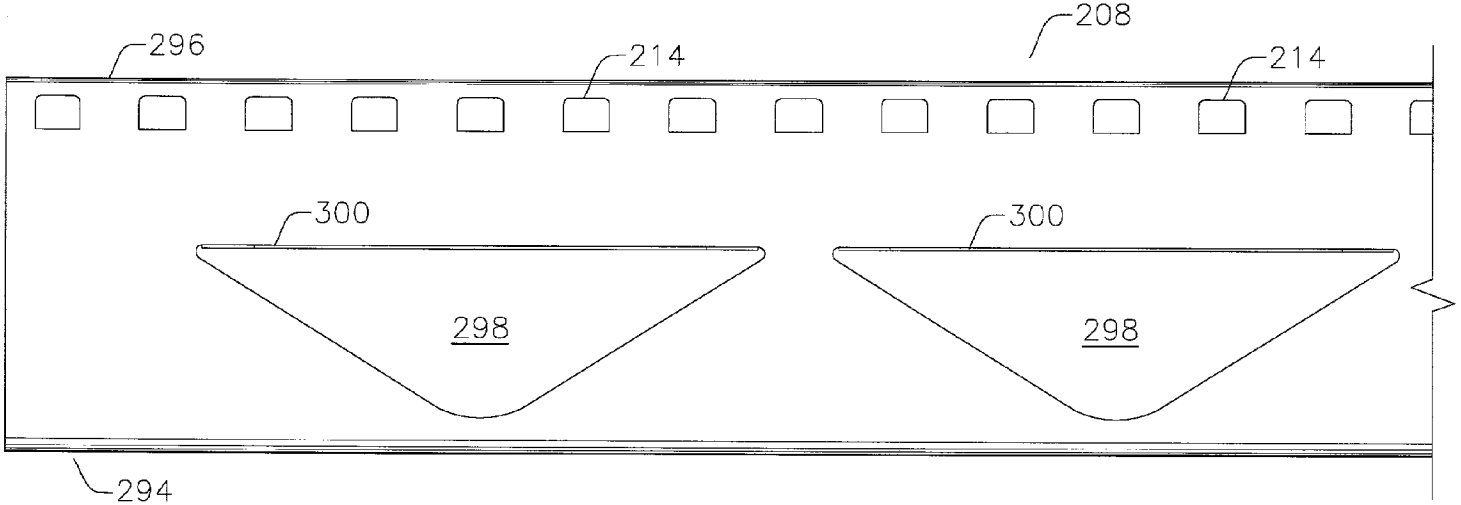
FIG. 22 is an outside view of a female joist member of a second embodiment of a composite floor system.
Figure 24:
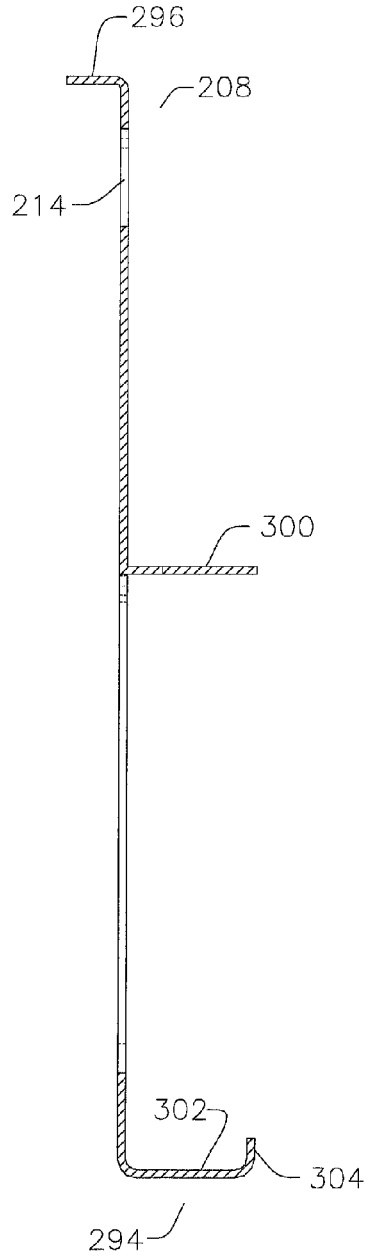
FIG. 24 is an end view of a female joist member of a second embodiment of a composite floor system.
Figure 25:
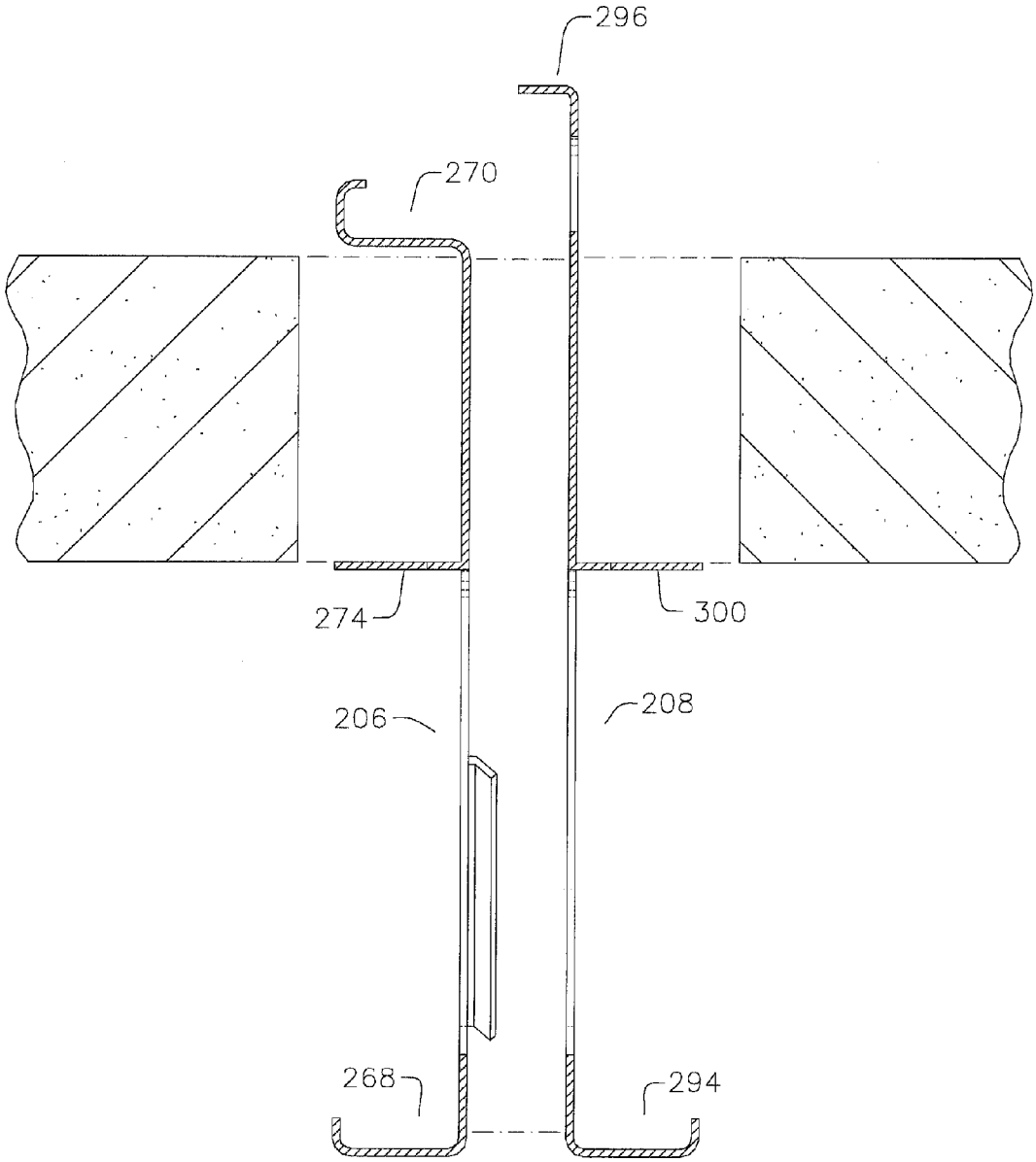
FIG. 25 is an end view of a female joist member, a male joist member and two deck panels before assembly of a second embodiment of a composite floor system.

With reference to FIGS. 22 and 24, the female frame member 208 includes a bottom flange support 294, a top flange 296, a plurality of female substantially triangular openings 298 and the plurality of shear connector openings 214. A middle flange 300 extends from a top leg of each triangular opening 298. The triangular opening 298 is sized to receive the first and second flanges of the triangle opening 272. Contact between the first and second flanges of the triangular openings 272 and the female triangular opening 298 resist shear forces between the male and female frame members. The bottom flange support 294 terminates a bottom of the female frame member 208. The bottom flange support 294 includes a bottom flange 302 and an attachment member 304 that extends substantially perpendicular from the bottom flange 302. The top flange 296 terminates a top of the female frame member 208. The plurality of shear connector openings 214 are formed through the female frame member 208, below the top flange 296. Plumbing, electrical wiring, ductwork or other building utilities may be run through the plurality of triangular openings 272, 298.

With reference to FIGS. 25, 26, 29 and 30, the male frame member 206 and the female frame member 208 are assembled to each other with a plurality of top joist clips 304 and a plurality of bottom joist clips 306. A deck panel 308 is supported on one end by the middle flange 274 and on the other end by the middle flange 300. The deck panel 308 is preferably fabricated from a foam material, but any other suitable material may also be used. Concrete 310 is poured on top of the deck panels 308. The concrete 310 flows through the plurality of shear connector openings 214 for bonding the concrete 310 to the plurality of joist assemblies 202. Each top joist clip 304 includes a base member 312, a retention tab 314 and a hook member 316. The retention tab 314 extends downward from one end of the base member 312 and the hook member 316 extends from the other end of the base member 312. The hook member 316 is preferably shaped as a substantial rectangle. The hook member 316 includes a bottom tab 318 that hooks under a bottom of the top member 288. The retention tab 314 is inserted through one of the shear connector openings 214 and retains the female frame member 208 against the male frame member 206. The top joist clip 304 is fabricated from a material having memory, such as spring steel or the like. The bottom joist clip 306 includes a first spring leg 320, a second spring leg 322 and a base member 324. The first spring leg 320 terminates one end of the base member 324 and the second spring leg 322 terminates the other end of the base member 324. The bottom joist clip 306 is fabricated from a material having memory, such that force is required to separate the first spring leg 320 from the second spring leg. The bottom joist clip 306 is inserted through the triangular openings of the male and female frame members pushed over a thickness thereof to retain the male and female frame members against each other.

Figure 31:
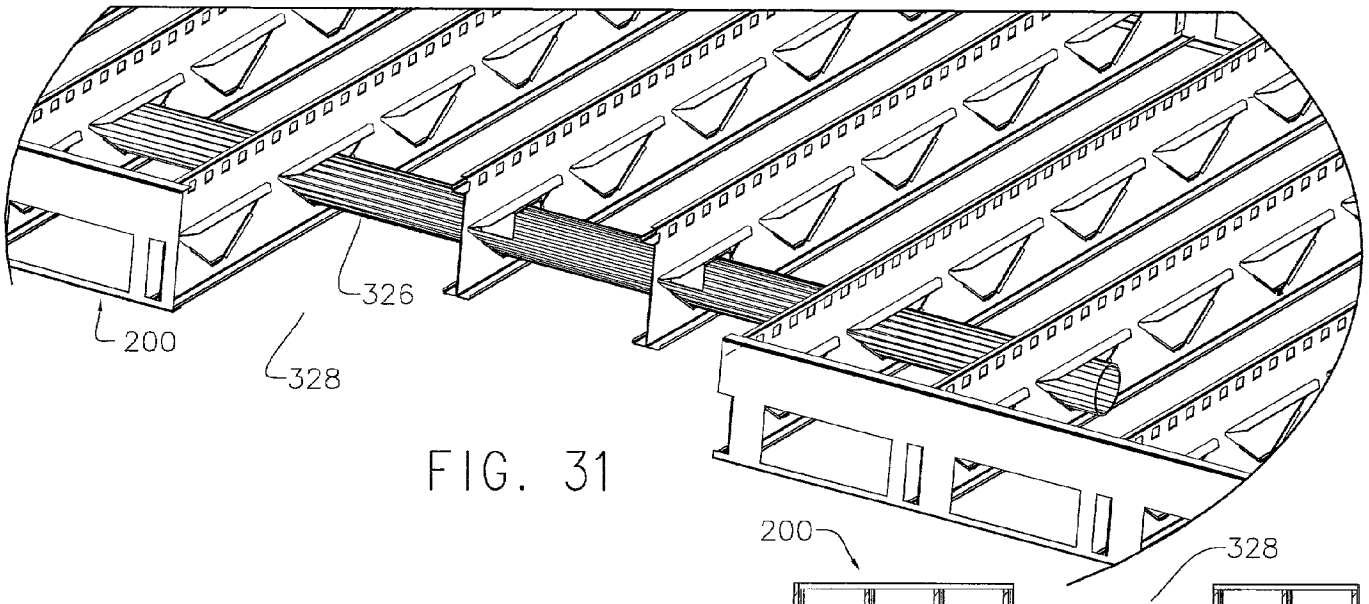
FIG. 31 is a perspective view of an opening support tube inserted into a second embodiment of a composite floor system.
Figure 33:
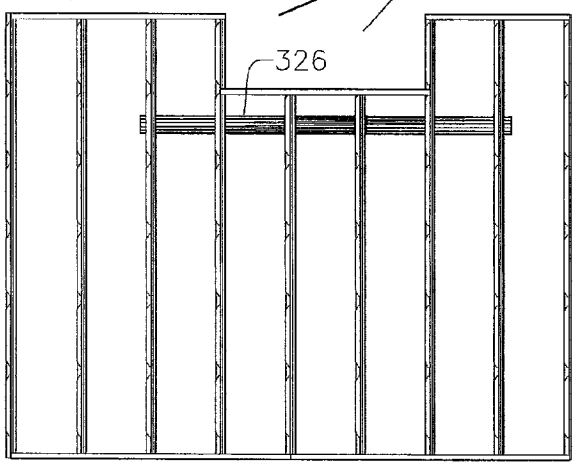
FIG. 33 is a top view of an opening support tube inserted into a second embodiment of a composite floor system.
Figure 32:
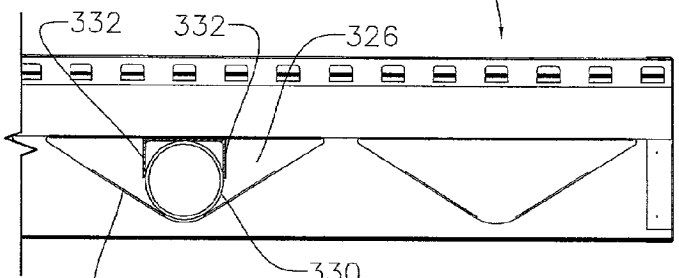
FIG. 32 is an end view of an opening support tube inserted into a second embodiment of a composite floor system.

With reference to FIGS. 31-33, an opening support tube 326 is inserted through the triangular openings 272, 298. The opening support tube 326 is used when an opening 328 is formed through the composite floor system 200. The opening support tube 326 preferably includes a tubular member 330 and a pair of right angle members 332. The pair of right angle members 332 are attached to a top of the tubular member 330 to provide a top flat surface.

Figure 36:
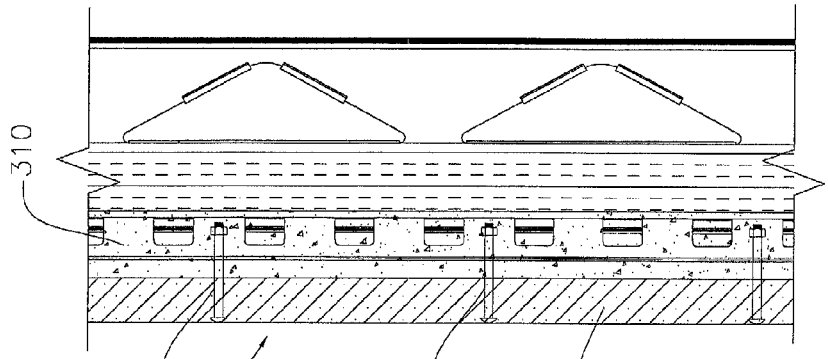
FIG. 36 is an enlarged end view of a second embodiment of a composite floor system used as a wall.
Figure 35:
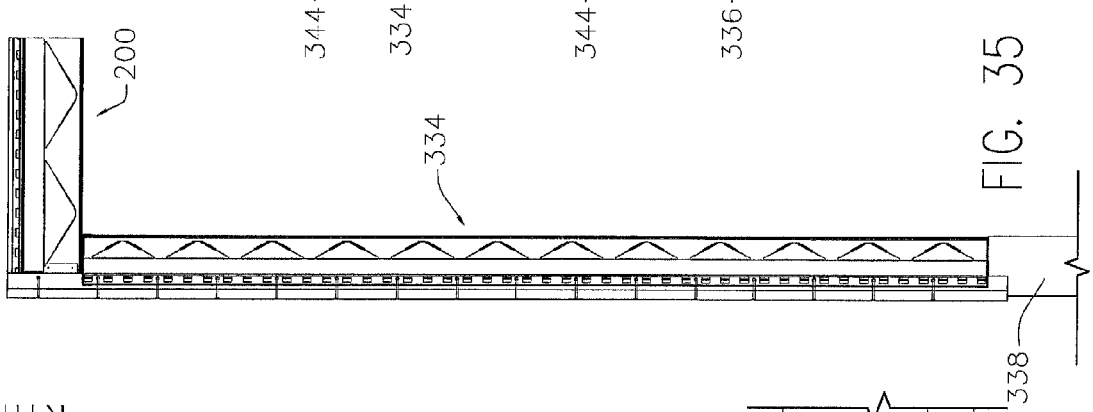
FIG. 35 is an end view of a second embodiment of a composite floor system used as a wall and a second composite floor system used as a floor.
Figure 34:
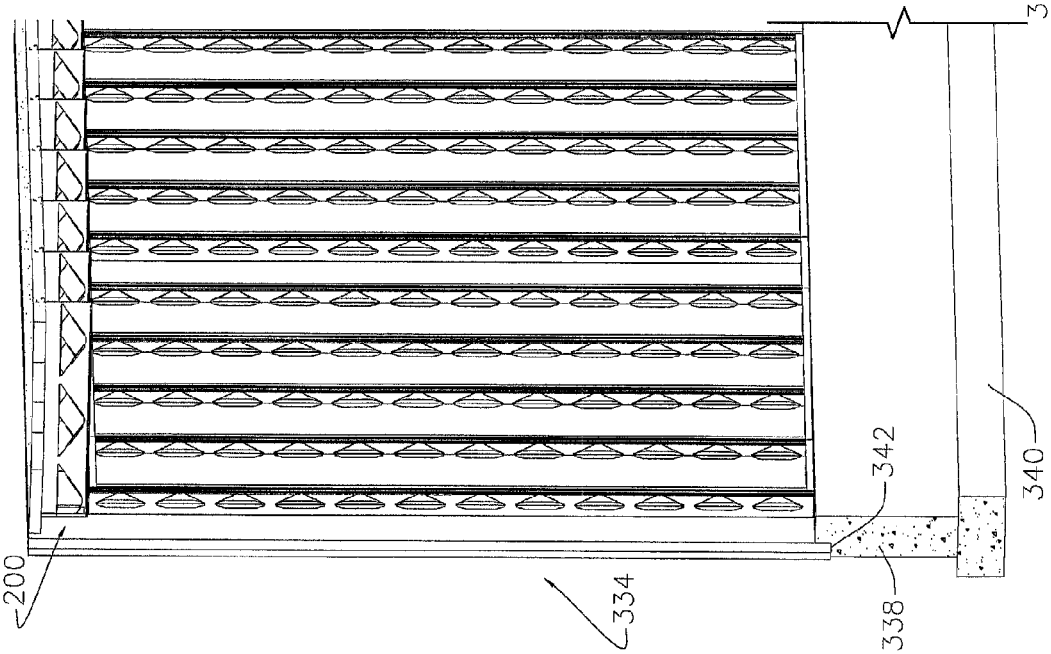
FIG. 34 is a perspective view of a second embodiment of a composite floor system used as a wall and a second composite floor system used as a floor.

With reference to FIGS. 34-36, a composite wall system 334 includes the composite floor system 200 and an exterior insulating finishing system 336. The exterior insulating finishing system 336 is well known in the art and need not be explained in detail. A concrete footing 338 is formed on a top of a normal foundation 338. An outer notch 342 is preferably formed on a top and an outer surface of the concrete footing 338. The outer notch 342 receives an end of the exterior insulating finishing system 336 to prevent water from entering a structure. The composite wall system 334 is attached to a top of the concrete footing 338 with any suitable method. The composite floor system 200 may be retained on a top of the composite wall system 334. The exterior insulating finishing system 336 includes a plurality of retention bolts 344 that extend from a backside thereof. The composite wall system 334 is created by assembling the composite floor system 200; pouring concrete 310 on top of the deck panels 308; and inserting the retention bolts 344 into the concrete 310, while the concrete 310 is still drying. The composite wall system 334 is then rotated into a vertical orientation, when the concrete cures.

While the invention has been described with reference to preferred embodiments, those skilled in the art will appreciate that certain substitutions, alterations and omissions may be made to the embodiments without departing from the spirit of the invention. Accordingly, the foregoing description is meant to be exemplary only, and should not limit the scope of the invention as set forth in the following claims.

What is claimed is:

1. An apparatus for supporting a concrete floor comprising:

at least two joist assemblies, each joist assembly includes a male frame member and a female frame member, said male frame member includes a male bottom support member and a top support member, a plurality of male guide openings are formed through said male frame member, at least one guide projection extends from a perimeter of each one of said plurality of male guide openings, said female frame member includes a female bottom support member and a top flange, a plurality of female guide openings are formed through said female frame member, each one of said plurality of female guide openings are sized to receive said at least one guide projection;

means for securing a top of said male frame member to a top of said female frame member, said means for securing capturing said top support member and said female frame member;

means for securing a bottom of said male frame member to a bottom of said female frame member; and means for retaining a distance between two adjacent joist assemblies of said plurality of joist assemblies, where an accessible opening remains at a location of the plurality of male guide openings and the plurality of female guide openings after the male frame member and the female frame member have been secured to one another wherein the accessible opening is configured such that at least ductwork can fit therethrough.

2. The apparatus for supporting a concrete floor of claim 1 wherein:

said means for securing a top includes a plurality of top joist clips, each one of said plurality of top joist clips includes a retention tab disposed on one end and a hook member disposed on the other end, said retention tab retaining said female frame member, said hook member capturing said male top support member.

3. The apparatus for supporting a concrete floor of claim 1 wherein:

said means for securing a bottom includes a plurality of bottom joist clips, each one of said plurality of bottom joist clips includes a first spring leg and a second spring leg, said plurality of bottom joist clips are inserted through said plurality of male and female guide openings, said male and female frame members are retained between said first and second spring legs.

4. The apparatus for supporting a concrete floor of claim 1 wherein:

said means for retaining a distance is a plurality of top straps, each end of each one of said plurality of top straps is engaged with two adjacent of said at least two female frame members.

5. The apparatus for supporting a concrete floor of claim 1 wherein:

said means for retaining a distance is a plurality of bottom straps, one end of one of said plurality of bottom straps is engaged with said female bottom support member, the other end of said one bottom strap is engaged with said male bottom support member.

6. The apparatus for supporting a concrete floor of claim 1, further comprising:

a male middle flange extending from a perimeter of said male guide opening, a female middle flange extending from a perimeter of said female guide opening.

7. The apparatus for supporting a concrete floor of claim 6, further comprising:

two brace members are inserted into a middle of each other, each one of said two brace members including a slot in one end for receiving one of said male middle flange and said female middle flange, the other end of each one of said two cross brace members is retained by one of said male bottom support member and said bottom female support member.

8. The apparatus for supporting a concrete floor of claim 6, further comprising:

a plurality of deck panels disposed on at least a portion of the joist assemblies.

9. An apparatus for supporting a concrete floor comprising:

at least two joist assemblies, each joist assembly includes a male frame member and a female frame member, said male frame member includes a male bottom support member and a top support member, a plurality of male guide openings are formed through said male frame member, at least one guide projection extends from a perimeter of each one of said plurality of male guide openings, said female frame member includes a female bottom support member and a top flange, a plurality of female guide openings are formed through said female frame member, each one of said plurality of female guide openings are sized to receive said at least one guide projection;

a male middle flange extending from a perimeter of said male guide opening, and a female middle flange extending from a perimeter of said female guide opening;

means for securing a top of said male frame member to a top of said female frame member, said means for securing capturing said top support member and said female frame member;

means for securing a bottom of said male frame member to a bottom of said female frame member; and means for retaining a distance between two adjacent joist assemblies of said plurality of joist assemblies.

10. The apparatus for supporting a concrete floor of claim 9 wherein:

said means for securing a top includes a plurality of top joist clips, each one of said plurality of top joist clips includes a retention tab disposed on one end and a hook member disposed on the other end, said retention tab retaining said female frame member, said hook member capturing said male top support member.

11. The apparatus for supporting a concrete floor of claim 9 wherein:

said means for securing a bottom includes a plurality of bottom joist clips, each one of said plurality of bottom joist clips includes a first spring leg and a second spring leg, said plurality of bottom joist clips are inserted through said plurality of male and female guide openings, said male and female frame members are retained between said first and second spring legs.

12. The apparatus for supporting a concrete floor of claim 9 wherein:

said means for retaining a distance is a plurality of top straps, each end of each one of said plurality of top straps is engaged with two adjacent of said at least two female frame members.

13. The apparatus for supporting a concrete floor of claim 9 wherein:

said means for retaining a distance is a plurality of bottom straps, one end of one of said plurality of top straps is engaged with said female bottom support member, the other end of said one top strap is engaged with said male bottom support member.

14. The apparatus for supporting a concrete floor of claim 9, further comprising:

two brace members are inserted into a middle of each other, each one of said two brace members including a slot in one end for receiving one of said male middle flange and said female middle flange, the other end of each one of said two cross brace members is retained by one of said male bottom support member and said bottom female support member.

15. The apparatus for supporting a concrete floor of claim 9, further comprising:

a plurality of deck panels disposed on at least a portion of the joist assemblies.

16. An apparatus for supporting a concrete floor comprising:

at least two joist assemblies, each joist assembly includes a male frame member and a female frame member, said male frame member includes a male bottom support member and a top support member, a plurality of male guide openings are formed through said male frame member, at least one guide projection extends from a perimeter of each one of said plurality of male guide openings, said female frame member includes a female bottom support member and a top flange, a plurality of female guide openings are formed through said female frame member, each one of said plurality of female guide openings are sized to receive said at least one guide projection;

means for securing a top of said male frame member to a top of said female frame member, said means for securing capturing said top support member and said female frame member;

means for securing a bottom of said male frame member to a bottom of said female frame member; and means for retaining a distance between two adjacent joist assemblies of said plurality of joist assemblies, where the at least one guide projection is integral to the male frame member prior to securing the male frame member to the female frame member, and where the at least one guide projection comprises a flat plate.

17. The apparatus for supporting a concrete floor of claim 16 wherein:

said means for securing a bottom includes a plurality of bottom joist clips, each one of said plurality of bottom joist clips includes a first spring leg and a second spring leg, said plurality of bottom joist clips are inserted through said male and female guide openings, said male and female frame members are retained between said first and second spring legs.

18. The apparatus for supporting a concrete floor of claim 16 wherein:

said means for retaining a distance is a plurality of top straps, each end of each one of said plurality of top straps is engaged with two adjacent of said at least two female frame members.

19. The apparatus for supporting a concrete floor of claim 16 wherein:

said means for retaining a distance is a plurality of bottom straps, each one of said plurality of top straps is engaged with said female bottom support member, the other end of said one top strap is engaged with said male bottom support member.

20. The apparatus for supporting a concrete floor of claim 16, further comprising:

two brace members are inserted into a middle of each other, each one of said two brace members including a slot in one end for receiving one of said male middle flange and said female middle flange, the other end of each one of said two cross brace members is retained by one of said male bottom support member and said bottom female support member.

21. An apparatus for supporting a concrete floor comprising:

at least two joist assemblies, each joist assembly includes a male frame member and a female frame member, said male frame member includes a male bottom support member and a top support member, a plurality of male guide openings are formed through said male frame member, at least one guide projection extends from a perimeter of each one of said plurality of male guide openings, said female frame member includes a female bottom support member and a top flange, a plurality of female guide openings are formed through said female frame member, each one of said plurality of female guide openings are sized to receive said at least one guide projection such that the at least one guide projection extends completely through only an associated female guide opening;

means for securing a top of said male frame member to a top of said female frame member, said means for securing capturing said top support member and said female frame member;

means for securing a bottom of said male frame member to a bottom of said female frame member; and means for retaining a distance between two adjacent joist assemblies of said plurality of joist assemblies.

22. An apparatus for supporting a concrete floor comprising:

at least two joist assemblies, each joist assembly includes a male frame member and a female frame member, said male frame member includes a male bottom support member and a top support member, a plurality of male guide openings are formed through said male frame member, at least one guide projection extends from a perimeter of each one of said plurality of male guide openings, said female frame member includes a female bottom support member and a top flange, a plurality of female guide openings are formed through said female frame member, each one of said plurality of female guide openings are sized to receive said at least one guide projection;

means for securing a top of said male frame member to a top of said female frame member, said means for securing capturing said top support member and said female frame member;

means for securing a bottom of said male frame member to a bottom of said female frame member; and means for retaining a distance between two adjacent joist assemblies of said plurality of joist assemblies, where at least one of the male guide openings and at least one of the female guide openings comprises a triangular shape.

23. The apparatus of claim 22 where each of the male guide openings and each of the female guide openings comprises a triangular shape.

* * * * *